US012722837B2

(12) United States Patent
Park et al.

(10) Patent No.: US 12,722,837 B2
(45) Date of Patent: Sep. 1, 2026

(54) TRAY FOR TRANSPORTING SEMICONDUCTOR DEVICE AND TRAY SYSTEM COMPRISING THE SAME

(71) Applicant: Samsung Electronics Co., Ltd., Suwon-si (KR)

(72) Inventors: Jae Hong Park, Suwon-si (KR); Tae-Geon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 36 days.

(21) Appl. No.: 18/493,152

(22) Filed: Oct. 24, 2023

(65) Prior Publication Data

US 2024/0286788 A1 Aug. 29, 2024

(30) Foreign Application Priority Data

Feb. 28, 2023 (KR) ..... 10-2023-0026925

(51) Int. Cl.
*B65D 1/36* (2006.01)
*B65D 85/38* (2006.01)

(52) U.S. Cl.
CPC ..... *B65D 1/36* (2013.01); *B65D 85/38* (2013.01); *B65D 2585/86* (2013.01)

(58) Field of Classification Search
CPC ..... B65D 1/36; B65D 85/38; B65D 2585/86; B65D 1/34; B65D 85/30; B65D 85/48; H01L 21/67; H01L 21/673; H01L 21/6735; H01L 21/67359
USPC ..... 206/706, 707, 710–713, 724, 717
See application file for complete search history.

(56) References Cited

U.S. PATENT DOCUMENTS

| | | | | |
|---|---|---|---|---|
| 7,093,717 | B2 | 8/2006 | Sakai et al. | |
| 7,410,060 | B2 * | 8/2008 | Crisp | H10P 72/16 206/706 |
| 7,504,315 | B2 * | 3/2009 | Matsubara | H10P 72/16 438/455 |
| 7,731,029 | B2 * | 6/2010 | Su | B65D 85/48 206/585 |
| 2004/0099568 | A1 * | 5/2004 | Zhang | B65D 71/70 206/707 |
| 2011/0089079 | A1 * | 4/2011 | Lo | H01L 21/67333 206/711 |

(Continued)

FOREIGN PATENT DOCUMENTS

| | | | |
|---|---|---|---|
| JP | 2005-014937 A | | 1/2005 |
| JP | 2005014937 | * | 1/2005 |

(Continued)

*Primary Examiner* — Rafael A Ortiz
(74) *Attorney, Agent, or Firm* — Wolf, Greenfield & Sacks, P.C.

(57) ABSTRACT

A tray for transporting a semiconductor device includes a plate, a loading portion on the plate and configured to support the semiconductor device, and a sidewall portion on the plate and surrounding at least a portion of the loading portion, wherein the sidewall portion includes a first sidewall, and the first sidewall includes a first inclined portion extending from the loading portion and defining a first angle with respect to an upper surface of the loading portion, and a first guide portion extending from the first inclined portion and defining a second angle with respect to the upper surface of the loading portion, the second angle being smaller than the first angle, and the first angle and the second angle are acute angles.

7 Claims, 26 Drawing Sheets

(56) References Cited

U.S. PATENT DOCUMENTS

| | | | | |
|---|---|---|---|---|
| 2013/0032508 | A1* | 2/2013 | Azuma | H01L 21/67333 206/710 |
| 2015/0114878 | A1 | 4/2015 | Lo | |
| 2015/0122698 | A1 | 5/2015 | Lo | |
| 2016/0086834 | A1* | 3/2016 | Kim | H01L 21/67333 206/710 |

FOREIGN PATENT DOCUMENTS

| | | | | |
|---|---|---|---|---|
| KR | 20100113774 | A | 10/2010 | |
| KR | 20110029869 | A | 3/2011 | |
| KR | 101509188 | B1 | 4/2015 | |
| KR | 20170004148 | A | 1/2017 | |
| KR | 20190019101 | A | 2/2019 | |
| WO | WO-2006115309 | A1 * | 11/2006 | B65D 21/083 |

* cited by examiner

TRAY FOR TRANSPORTING SEMICONDUCTOR DEVICE AND TRAY SYSTEM COMPRISING THE SAME

CROSS-REFERENCE TO RELATED APPLICATION

This application claims priority under 35 U.S.C. 119 from Korean Patent Application No. 10-2023-0026925, filed on Feb. 28, 2023 in the Korean Intellectual Property Office, the contents of which are herein incorporated by reference in their entirety.

BACKGROUND

The present disclosure relates to a tray for transporting a semiconductor device and a tray system comprising the same.

As a semiconductor device (e.g., SSD) becomes more precise, it is increasingly important to safely transport the semiconductor device. Therefore, it is required to properly load the semiconductor device on a tray in a step of loading the tray and prevent the semiconductor device from being detached from the tray in a step of transporting the tray on which the semiconductor device is loaded.

The semiconductor device may not be loaded at once on the tray. In this case, gripping the semiconductor device again to be properly loaded on the tray increases the probability that the semiconductor device will be contaminated.

SUMMARY

An object of the present disclosure is to provide a tray for transporting a semiconductor device, which is capable of stably loading the semiconductor device thereon and transporting the semiconductor device in a state that the loaded semiconductor device is not detached therefrom.

Another object of the present disclosure is to provide a tray system capable of stably loading a semiconductor device thereon and transporting the semiconductor device in a state that the loaded semiconductor device is not detached therefrom.

The objects of the present disclosure are not limited to those mentioned above and additional objects of the present disclosure, which may not be mentioned herein, will be clearly understood by those skilled in the art from the following description of the present disclosure.

According to an aspect of the present disclosure, there is provided a tray for transporting a semiconductor device, the tray including a plate, a loading portion on the plate and configured to support the semiconductor device, and a sidewall portion on the plate and surrounding at least a portion of the loading portion, wherein the sidewall portion includes a first sidewall, and the first sidewall includes a first inclined portion extending from the loading portion and defining a first angle with respect to an upper surface of the loading portion, and a first guide portion extending from the first inclined portion and defining a second angle with respect to the upper surface of the loading portion, the second angle being smaller than the first angle, and the first angle and the second angle are acute angles.

According to another aspect of the present disclosure, there is provided a tray for transporting a semiconductor device, the tray including a plate, a loading portion on the plate and configured to support the semiconductor device, and a sidewall portion on the plate and surrounding at least a portion of the loading portion, wherein the sidewall portion includes a first sidewall, the first sidewall includes a first inclined portion connected to the loading portion and forming a first angle with respect to an upper surface of the loading portion, and a first guide portion connected to the first inclined portion and forming a second angle with respect to the upper surface of the loading portion, the second angle being smaller than the first angle, the sidewall portion includes a second sidewall opposite the first sidewall, the second sidewall includes a second inclined portion connected to the loading portion and forming the first angle with respect to the upper surface of the loading portion, and a second guide portion connected to the second inclined portion and forming the second angle with respect to the upper surface of the loading portion, the sidewall portion includes a third sidewall connected to and extending between the first sidewall and the second sidewall, and the third sidewall includes a third inclined portion connected to the loading portion and forming the first angle with respect to the upper surface of the loading portion, and a third guide portion connected to the third inclined portion and forming the second angle with respect to the upper surface of the loading portion, the first angle and the second angle are acute angles, and the plate, the loading portion, and the sidewall portion are integrally formed.

According to still another aspect of the present disclosure, there is provided a tray system comprising a plurality of trays for transporting a plurality of semiconductor devices, a respective tray including a plate, a loading portion on the plate and configured to support the semiconductor device, and a sidewall portion on the plate and surrounding at least a portion of the loading portion, wherein the sidewall portion includes a first sidewall, the first sidewall includes, a first inclined portion connected to the loading portion and forming a first angle with respect to an upper surface of the loading portion, and a first guide portion connected to the first inclined portion and forming a second angle with respect to the upper surface of the loading portion, the second angle being smaller than the first angle, the first angle and the second angle are acute angles, and the plurality of trays are arranged in the form of a matrix.

BRIEF DESCRIPTION OF THE DRAWINGS

The above and other aspects and features of the present disclosure will become more apparent by describing in detail example embodiments thereof with reference to the attached drawings, in which.

DETAILED DESCRIPTION

Figure 1:
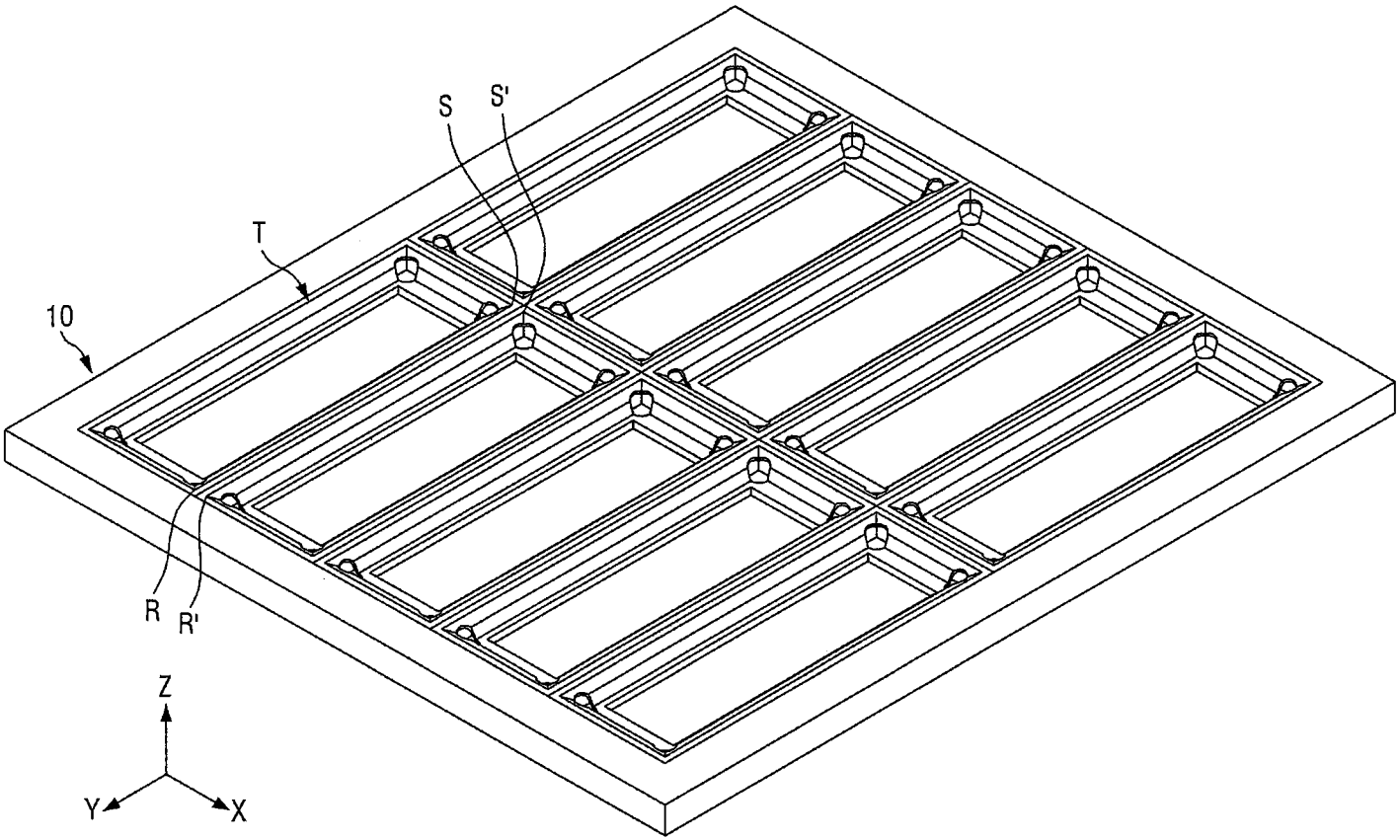
FIG. 1 is a perspective view illustrating a tray system in which a plurality of trays are disposed.

Hereinafter, the embodiments of the present disclosure will be described in detail with reference to the accompanying drawings. The same reference numerals will be used for the same elements on the drawings, and their repeated description may be omitted in the interest of brevity.

Figure 2:
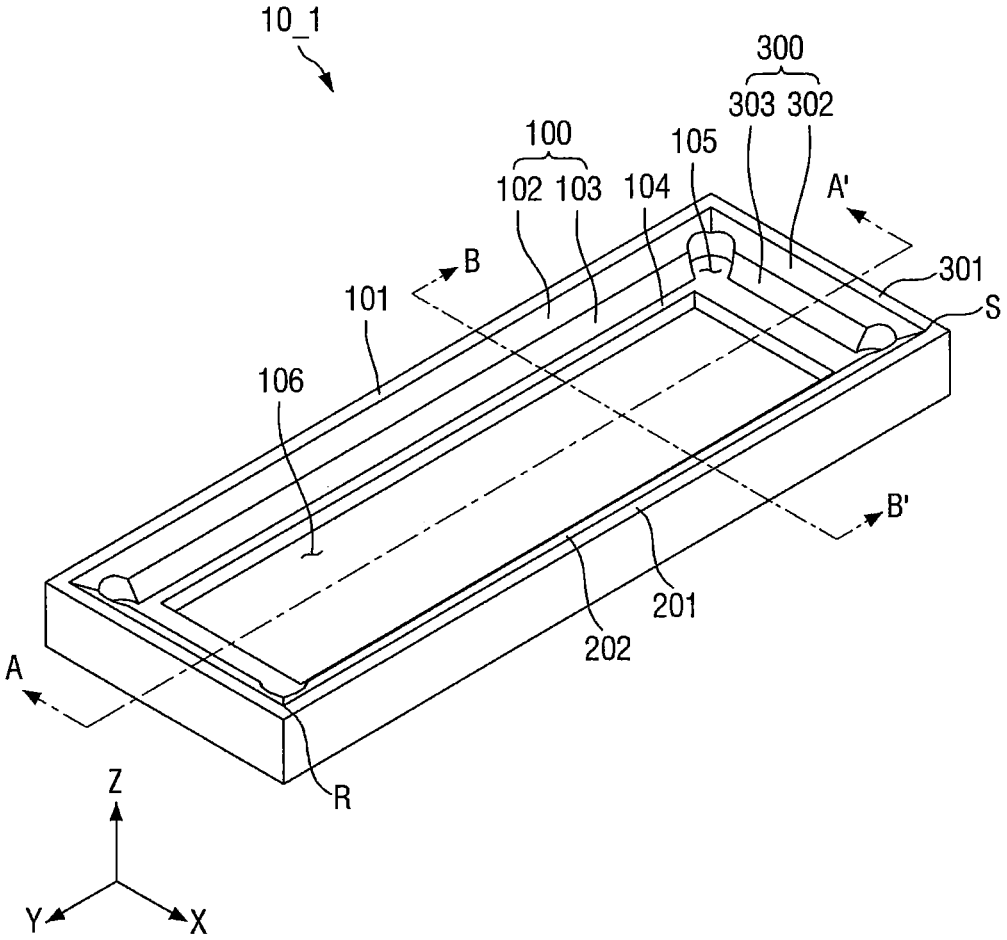
FIG. 2 is a perspective view illustrating a tray according to some embodiments of the present disclosure.
Figure 3:
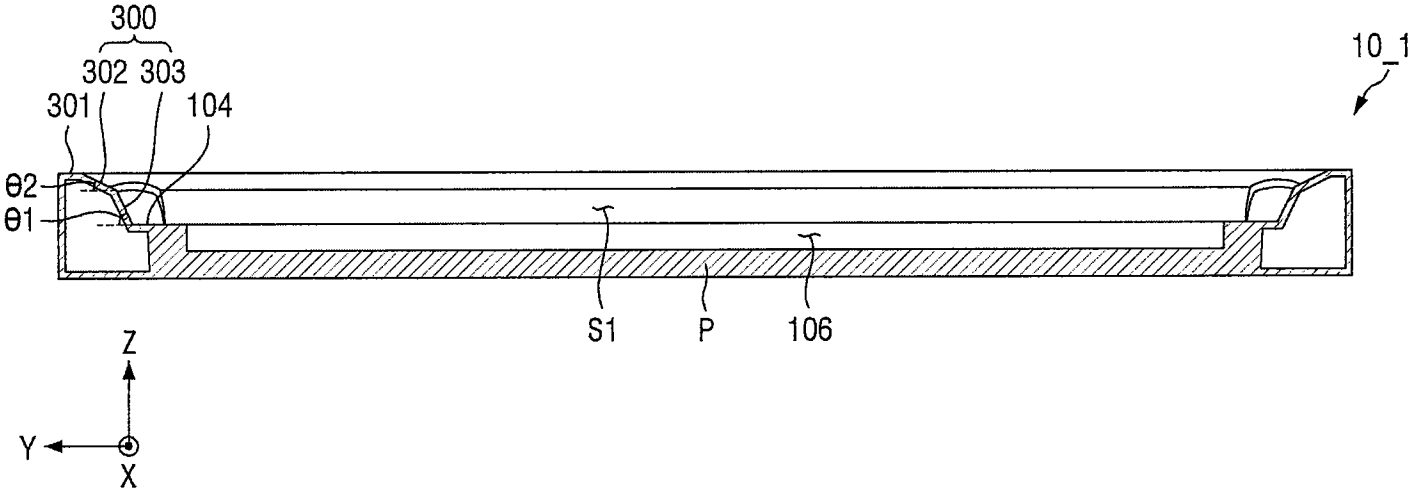
FIG. 3 is a cross-sectional view taken along line A-A' of FIG. 2.
Figure 4:
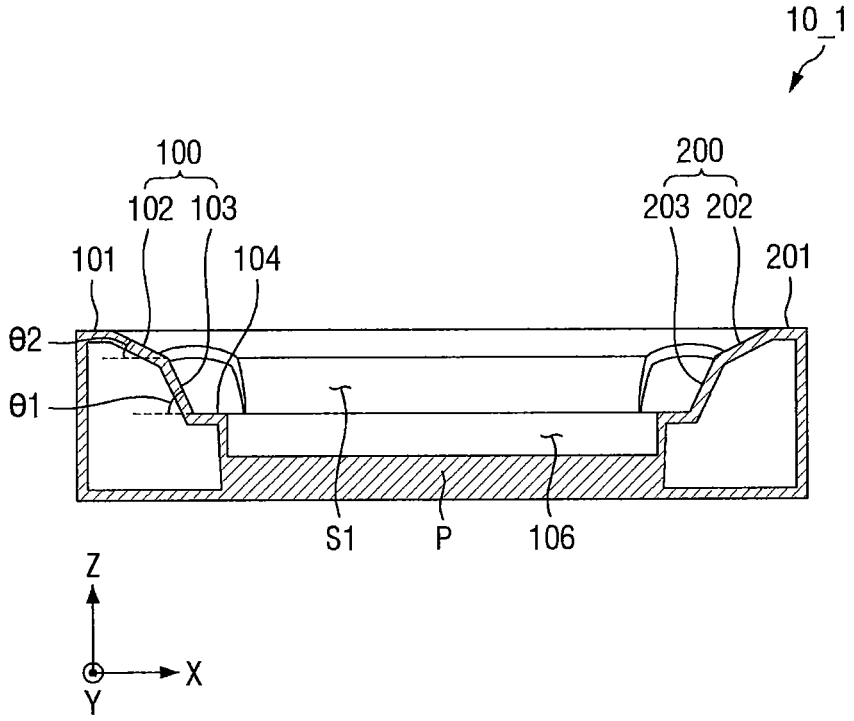
FIG. 4 is a cross-sectional view taken along line B-B' of FIG. 2.
Figure 5:
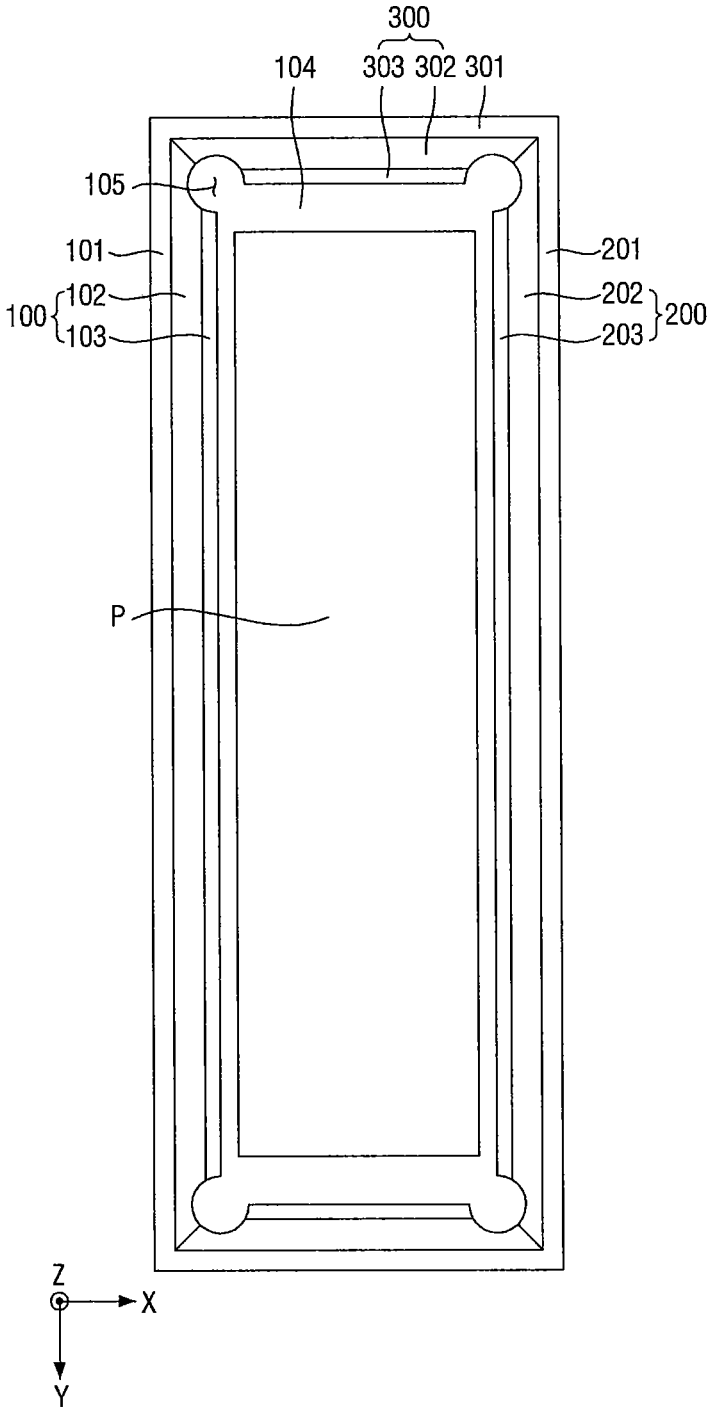
FIG. 5 is a plan view illustrating the tray shown in FIG. 2.
Figure 6:
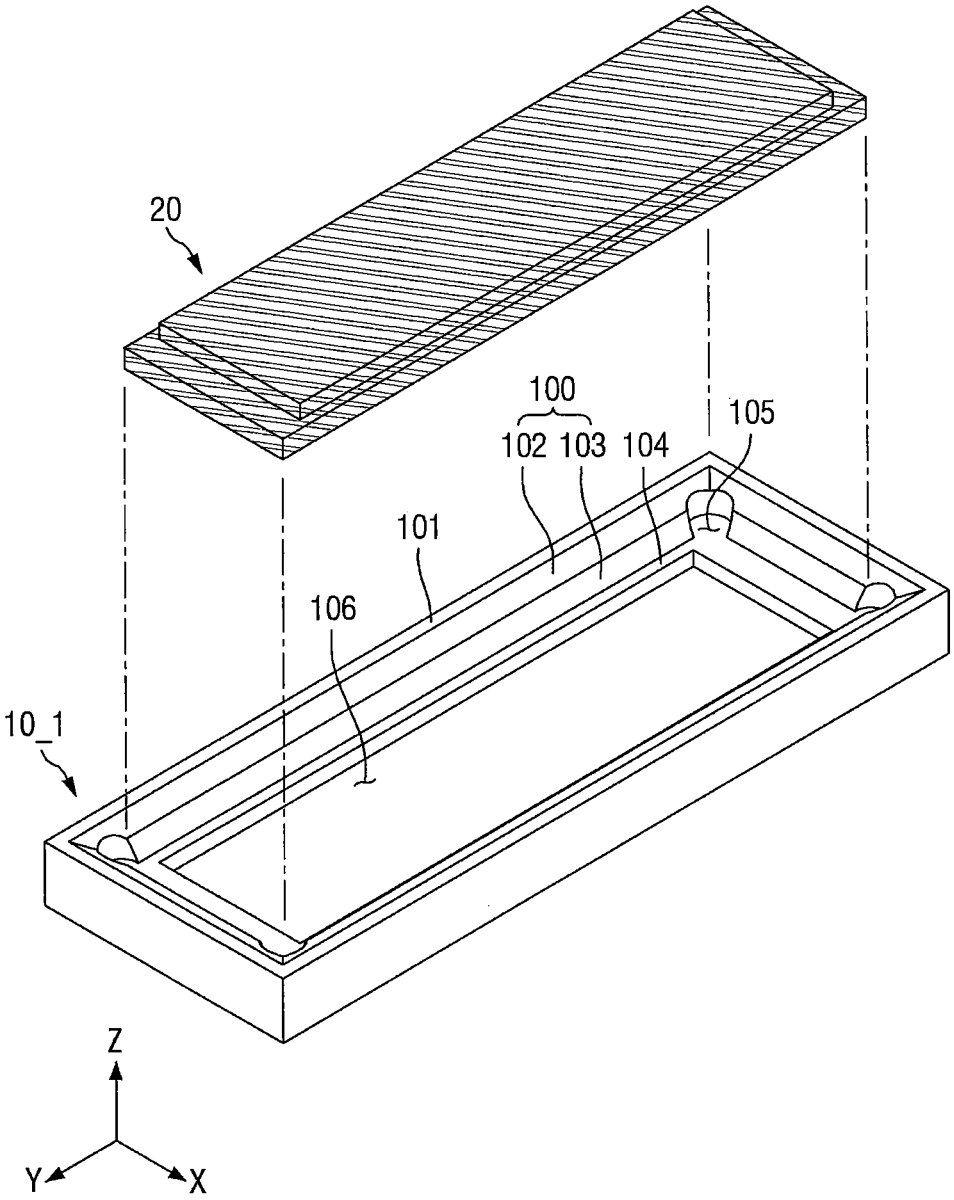
FIG. 6 is a perspective view of a tray illustrating a state before a semiconductor device is loaded on the tray shown in FIG. 2.

FIG. 1 is a perspective view illustrating a tray system in which a plurality of trays are disposed. FIG. 2 is a perspective view illustrating a tray according to some embodiments of the present disclosure. FIG. 3 is a cross-sectional view taken along line A-A' of FIG. 2. FIG. 4 is a cross-sectional view taken along line B-B' of FIG. 2. FIG. 5 is a plan view illustrating the tray shown in FIG. 2. FIG. 6 is a perspective view of a tray illustrating a state before a semiconductor device is loaded on the tray shown in FIG. 2.

Referring to FIGS. 1 to 6, a tray T is used to transport a semiconductor device 20. For example, the semiconductor device 20 may be a printed circuit board (PCB), and in more detail, the PCB may be an SSD M.2 product or the like. The PCB is completed after being modularized by forming various thin films. The PCB before being modularized and the PCB after being modularized may be different from each other in size. The tray T may further include a packaging groove on a lower surface to load both the PCB before being modularized and the PCB completed after being modularized, and a detailed description thereof will be described below.

The semiconductor device 20 may be loaded on the tray T to be stored or transported. The tray T may be used to load different types of semiconductor devices 20, which are different from each other in sizes, or may be used to load semiconductor devices 20 having different sizes via a process.

Referring back to FIG. 1, a tray system 10 may include a plurality of trays T. The plurality of trays T may be held in a base or a tray holder. A loading portion 104 including a loading space may be provided for each tray T so that one semiconductor device 20 may be loaded on the corresponding loading portion 104. The respective loading portions 104 of the respective trays T may have substantially the same shape. The trays T may be arranged in the form of a matrix. Although FIG. 1 illustrates that the trays T are arranged in two rows and five columns, the present disclosure is not limited thereto.

The trays T may include a first tray 10_1, a second tray 10_2, a third tray 10_3, a fourth tray 10_4, or a fifth tray 10_5, but is not limited thereto. A detailed description of the first tray 10_1, the second tray 10_2, the third tray 10_3, the fourth tray 10_4, or the fifth tray 10_5 will be described below.

Referring back to FIGS. 2 to 5, the tray T may be the first tray 10_1. The first tray 10_1 may include a plate P, a loading portion 104, a sidewall portion, and an edge portion. For example, the plate P, the loading portion 104, the sidewall portion, and the edge portion may be integrally formed to form the first tray 10_1.

The edge portion may include a first edge portion 101, a second edge portion 201, a third edge portion 301, a fourth edge portion 401, a fifth edge portion 501, and a sixth edge portion 601, but is not limited thereto. A detailed description of the first edge portion 101, the second edge portion 201, the third edge portion 301, the fourth edge portion 401, the fifth edge portion 501, and the sixth edge portion 601 will be described below.

The plate P may be installed to support the loading portion 104. For example, the plate P may be a plate-shaped structure extended in parallel with a plane (e.g., X-Y plane) that crosses or is perpendicular to a third direction Z. The plate P may have a rectangular shape having four edges, but is not limited thereto.

In some embodiments, the plate P may extend in a first direction Y. Therefore, the plate P may have a rectangular shape in which a length in the first direction Y is longer than a length in a second direction X.

The loading portion 104 may be a structure extending along the periphery of the plate P, having a thickness in the third direction Z. For example, the loading portion 104 may extend along an outer edge of the plate P. In addition, the loading portion 104 may be a structure covering only a portion of an upper surface of the plate P. Thus, when the tray T is viewed in the third direction Z, a portion of the upper surface of the plate P may be observed.

In some embodiments, the loading portion 104 and the plate P may have a step difference. When the tray T is viewed in the third direction Z, it may be observed that the loading portion 104 extends along the edge of the plate P.

In some embodiments, a packaging groove 106 may protrude or extend from the plate P (or may be on the plate P), and may be formed or defined in the loading portion 104. For example, an inner sidewall of the loading portion 104 and the upper surface of the plate P may define the packaging groove 106. The packaging groove 106 may have a hollow rectangular parallelepiped shape composed of five surfaces except for an upper surface. In this case, the inner sidewall of the loading portion 104 may define a sidewall of the packaging groove 106, and the upper surface of the plate P may define a lower surface of the packaging groove 106. In addition, the upper surface of the packaging groove 106 may have a perforated structure, so that the upper surface of the plate P may be observed when the plate P is observed in the third direction Z.

The packaging groove 106 may have various shapes as the semiconductor device 20 is modularized, but may load the semiconductor device 20 so that an upper surface of the semiconductor device 20 may be exposed (hereinafter, referred to as "top loading"), or may load the semiconductor device 20 so that a lower surface of the semiconductor device 20 may be exposed (hereinafter referred to as "bottom loading"). A detailed description of the behavior of the packaging groove 106 to top-load or bottom-load the semiconductor device 20 will be described below with reference to FIGS. 10 and 11.

In some embodiments, an upper surface of the loading portion 104 may be in contact with the semiconductor device 20 to be loaded. As a contact area between the upper surface of the loading portion 104 and the semiconductor device 20 to be loaded is increased, a friction area between the upper surface of the loading portion 104 and the semiconductor device 20 to be loaded is increased. Therefore, the semiconductor device 20 may be more firmly fixed in spite of an external force applied to the tray T from the outside.

A sidewall portion may be formed to surround at least a portion of the loading portion 104 on the plate P, and may include a first sidewall 100. The first sidewall 100 may include a first inclined portion 103 and a first guide portion 102. The first inclined portion 103 may be connected to or extend from the loading portion 104, and may form or define a first angle θ1 with respect to the upper surface of the loading portion 104. The first guide portion 102 may be connected to or extend from the first inclined portion 103, and may form or define a second angle θ2 with respect to the upper surface of the loading portion 104.

The first inclined portion 103 may properly support an outer wall of the semiconductor device 20 so that the loaded semiconductor device 20 does not move in a horizontal direction. The first guide portion 102 has a relatively gentle slope. Therefore, when freely falling to the upper surface of the tray T, the semiconductor device 20 may slide along the first guide portion 102 and be safely loaded on the loading portion 104.

In some embodiments, the first inclined portion 103 and the loading portion 104 may define a first loading space S1. The semiconductor device 20 to be loaded may be loaded on the first loading space S1. In detail, the loading portion 104 may support the lower surface of the semiconductor device 20 to be loaded, thereby preventing the semiconductor device 20 from being detached in the third direction Z. In addition, the first inclined portion 103 surrounds sides of the semiconductor device 20. Therefore, the first inclined portion 103 may prevent the semiconductor device 20 from being detached due to the movement of the semiconductor device 20 on a plane (e.g., X-Y plane) crossing the third direction Z.

In some embodiments, the first angle θ1 may be an acute angle. For example, the first angle θ1 may be 89°. When the first angle θ1 is an obtuse angle and the semiconductor device 20 is not loaded, a size of an upper surface of the first packaging space is smaller than that of the lower surface of the semiconductor device 20 so that the semiconductor device 20 may not be inserted into the first packaging space. In addition, when the first angle θ1 is an obtuse angle and the semiconductor device 20 is loaded, the size of the upper surface of the first packaging space is smaller than that of the upper surface of the semiconductor device 20, so that the stacked semiconductor device 20 may not be discharged in the third direction Z. When the first angle θ1 is a right angle, the semiconductor device 20 may be inserted into the first packaging space in a fitting structure. Therefore, there may be friction between a sidewall of the semiconductor device 20 and the first inclined portion 103 so that the semiconductor device 20 may not be inserted into the loading portion 104 to be completely in contact therewith. Therefore, the first angle θ1 may be an acute angle so that the semiconductor device 20 slides along the inclination of the first inclined portion 103 and is loaded on the loading portion 104. That is, the first angle θ1 may be less than 90°.

In some embodiments, the second angle θ2 may be an acute angle. For example, the second angle θ2 may be 87°. The second angle θ2 may be an acute angle in the same manner as the reason why the first angle θ1 described above may be an acute angle. That is, the second angle θ2 may be less than 90°.

In some embodiments, the second angle θ2 may be less than the first angle θ1. The first guide portion 102 induces the semiconductor device 20 to be safely inserted into the first loading space S1 by making the second angle θ2 relatively gentle. The first inclined portion 103 induces the semiconductor device 20 to be quickly loaded on the loading portion 104 by making the first angle θ1 relatively steep.

The sidewall portion may be formed to surround at least a portion of the loading portion 104 on the plate P, and may include a second sidewall 200 facing or opposite the first sidewall 100. The second sidewall 200 may include a second inclined portion 203 and a second guide portion 202. The second inclined portion 203 is connected to or extends from the loading portion 104, and may form or define a first angle θ1 with respect to the upper surface of the loading portion 104. The second guide portion 202 is connected to or extends from the second inclined portion 203, and may form or define a second angle θ2 with respect to the upper surface of the loading portion 104.

The second inclined portion 203 may properly support the outer wall of the semiconductor device 20 so that the loaded semiconductor device 20 does not move in a horizontal direction. The second guide portion 202 has a relatively gentle slope. Therefore, when freely falling to the upper surface of the tray T, the semiconductor device 20 may slide along the second guide portion 202 and be safely loaded on the loading portion 104.

In some embodiments, the second inclined portion 203 and the loading portion 104 may define a first loading space S1. This is the same as that the first inclined portion 103 and the loading portion 104 may define the first loading space S1.

In some embodiments, as described above, the first angle θ1 and the second angle θ2 may be acute angles, and the second angle θ2 may be smaller than the first angle θ1.

The sidewall portion may be formed to surround at least a portion of the loading portion 104 on the plate P, and may include a third sidewall 300 connected to the first sidewall 100. The third sidewall 300 may extend between the first sidewall 100 and the second sidewall 200. The third sidewall 300 may include a third inclined portion 303 and a third guide portion 302. The third inclined portion 303 is connected to or extends from the loading portion 104, and may form or define a first angle θ1 with respect to the upper surface of the loading portion 104. The third guide portion 302 is connected to or extends from the third inclined portion 303, and may form or define a second angle θ2 with respect to the upper surface of the loading portion 104.

The third inclined portion 303 may properly support the outer wall of the semiconductor device 20 so that the loaded semiconductor device 20 does not move in a horizontal direction. The third guide portion 302 has a relatively gentle slope. Therefore, when freely falling to the upper surface of the tray T, the semiconductor device 20 may slide along the third guide portion 302 and be safely loaded on the loading portion 104.

In some embodiments, the third inclined portion 303 and the loading portion 104 may define a first loading space S1. This is the same as that the first inclined portion 103 and the loading portion 104 may define the first loading space S1.

In some embodiments, as described above, the first angle θ1 and the second angle θ2 may be acute angles, and the second angle θ2 may be smaller than the first angle θ1. It will be appreciated that a fourth sidewall may be opposite the third sidewall 300, and may include a fourth inclined portion and a fourth guide portion in the manner described above.

The edge portion may surround the sidewall. For example, the first edge portion may be connected to an upper surface of the first sidewall and extended along the periphery of the first sidewall.

In some embodiments, the edge portion may include a first edge portion 101. The first edge portion 101 may be connected to or extend from the first guide portion 102 and surround the first guide portion 102 along the periphery of an upper surface of the first guide portion 102. The first edge portion 101 may be positioned on the plane (e.g., X-Y plane) crossing the third direction Z, but is not limited thereto.

In some embodiments, the edge portion may include a second edge portion 201. The second edge portion 201 may be connected to or extend from the second guide portion 202 and surround the second guide portion 202 along the periphery of an upper surface of the second guide portion 202. The second edge portion 201 may be positioned on the plane (e.g., X-Y plane) crossing the third direction Z, but is not limited thereto.

In some embodiments, the edge portion may include a third edge portion 301. The third edge portion 301 may be connected to or extend from the third guide portion 302 and surround the third guide portion 302 along the periphery of an upper surface of the third guide portion 302. The third edge portion 301 may be positioned on the plane (e.g., X-Y plane) crossing the third direction Z, but is not limited thereto. It will be appreciated that a fourth edge portion may be connected to or extend from the fourth guide portion and surround the fourth guide portion along the periphery of an upper surface of the fourth guide portion.

In some embodiments, the respective edge portions may have widths, but the widths of the respective edge portions may be different from each other. For example, the width of the first edge portion 101 may be greater than that of the second edge portion 201. The width of each edge portion may be changed to adjust a distance between the trays T adjacent to each other in the tray system 10.

In some embodiments, adjacent edge portions may connect the adjacent trays T. For example, as shown in FIG. 1, the first edge portion 101 that is in contact with a line segment RS and an edge portion that is in contact with line segment R'S' may be connected to or abut each other. As a result, the adjacent edge portions may connect the adjacent trays T so that the plurality of trays T may be arranged in the form of a matrix.

A first protection groove 105 may be positioned at the corner of the loading portion 104. The first protection groove 105 may be provided at a portion where adjacent sidewalls are connected to each other or meet. For example, the first protection groove 105 may be provided at a portion where the first sidewall 100 and the third sidewall 300 are connected to each other or meet. The first sidewall 100 may include a first guide portion 102 and a first inclined portion 103, and the third sidewall 300 may include a third guide portion 302 and a third inclined portion 303. Therefore, a through groove may be provided at a portion where the first guide portion 102 and the third guide portion 302 are connected to each other or meet and a portion where the first inclined portion 103 and the third inclined portion 303 are connected to each other or meet.

The first protection groove 105 is formed to expose the loading portion 104 by passing through guide portions adjacent to each other and inclined portions adjacent to each other. For example, the first protection groove 105 may pass through the first guide portion 102 and the third guide portion 302, which are adjacent to each other. In addition, the first protection groove 105 may pass through the first inclined portion 103 and the third inclined portion 303, which are adjacent to each other. As a result, the upper surface of the loading portion 104 is exposed.

The first protection groove 105 may have a hollow shape. For example, the first protection groove 105 may be a cylindrical shape that includes a bottom surface of a fan shape having a central angle of 270° formed by crossing linear portions each other at the edge of the loading portion 104 based on a vertex where two straight lines cross each other at the edge of the loading portion 104.

The first protection groove 105 may prevent the semiconductor device 20 from being damaged. For example, the semiconductor device 20 may have a rectangular shape having four corners, and the first protection groove 105 may accommodate four corners of the semiconductor device 20. The corner may be sharp in shape and thus may be subjected to a greater pressure than the case that it is in contact with the tray T. The first protection groove 105 has a hollow shape so that the corner of the semiconductor device 20 does not directly contact the tray T, thereby preventing the semiconductor device 20 from being damaged.

The tray T may be made of a variety of materials. In more detail, the tray T may include a polymer compound that may be injected. The polymer compound may include polypropylene (PP), polyethylene terephthalate (PET), polyvinyl chloride (PVC), acrylonitrile-butadiene-styrene (ABS), polystyrene (PS), polyethylene (PE), and the like, but the present disclosure is not limited thereto.

The semiconductor device 20 may move through a semiconductor device transfer picker. For example, the semiconductor device transfer picker may move the semiconductor device 20 by using a vacuum adsorption method. After the semiconductor device transfer picker is vacuum-adsorbed on one surface of the semiconductor device 20, and the semiconductor device transfer picker is moved to a desired position in a state that the semiconductor device 20 is vacuum-adsorbed, the vacuum state may be released to load the semiconductor device 20 at a desired position.

FIGS. 7 to 10 are views illustrating an operation of loading a semiconductor device on the tray shown in FIG. 2. FIGS. 7 to 10 illustrate an operation in which a semiconductor device is loaded as an example of a top-loaded behavior of a semiconductor device.

Figure 7:
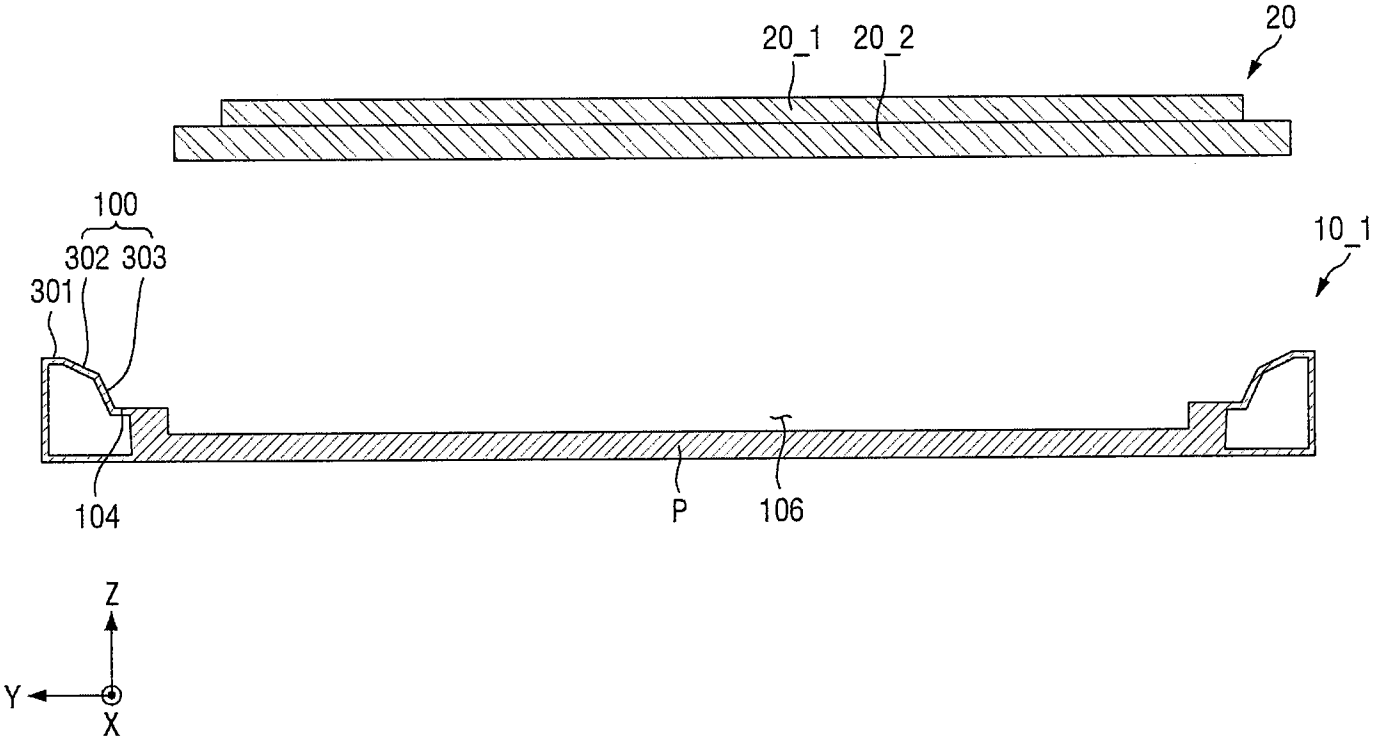
FIGS. 7 to 10 are views illustrating an operation of loading a semiconductor device on the tray shown in FIG. 2.

Referring to FIG. 7, as a first step, the semiconductor device 20 may freely fall toward an upper surface of a first tray 10_1. The semiconductor device 20 may freely fall to a position in which the semiconductor device 20 is not fitted to the loading portion 104 due to the influence of air resistance or the like in the middle of being loaded.

Figure 8:
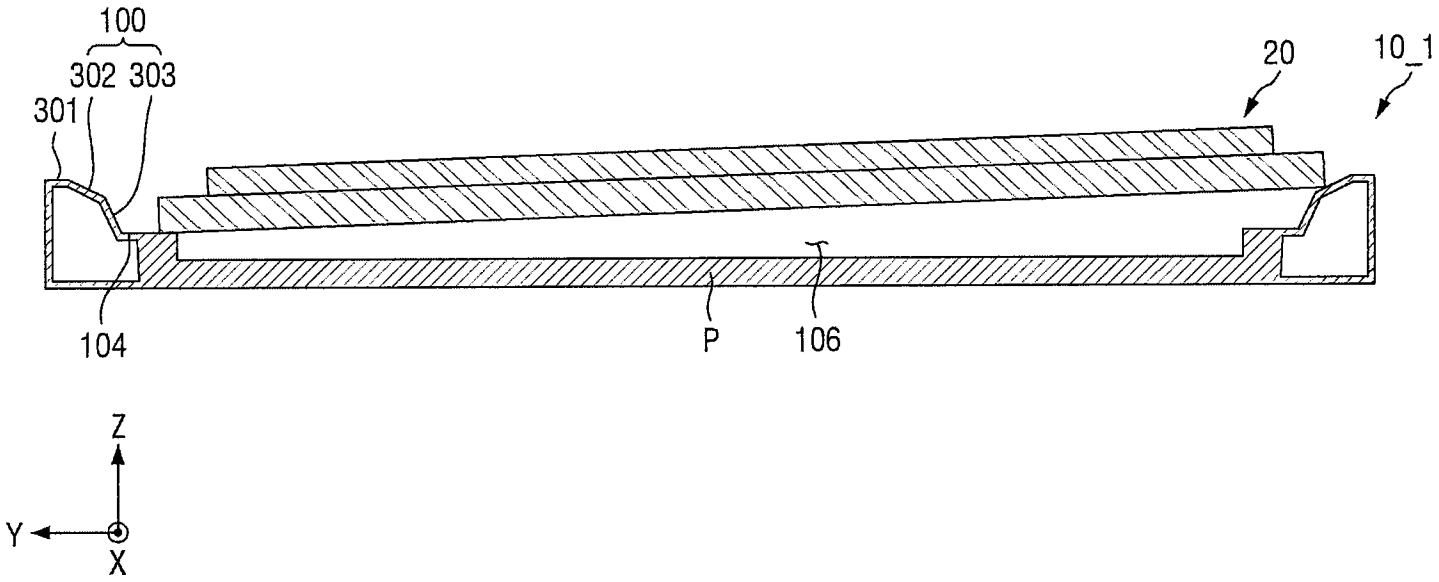

Referring to FIG. 8, as a second step, one side of the semiconductor device 20 may fall to a guide portion of the first tray 10_1 and thus may be in contact with the guide portion, and the other side of the semiconductor device 20 may fall to the loading portion 104 of the first tray 10_1 and thus may be in contact with the loading portion 104. That is, one side of the semiconductor device 20 may non-elastically collide with the guide portion, and the other side of the semiconductor device 20 may non-elastically collide with the loading portion 104. Although not shown, one side of the semiconductor device 20 may be in contact with an inclined portion rather than the guide portion of the first tray 10_1.

Figure 9:
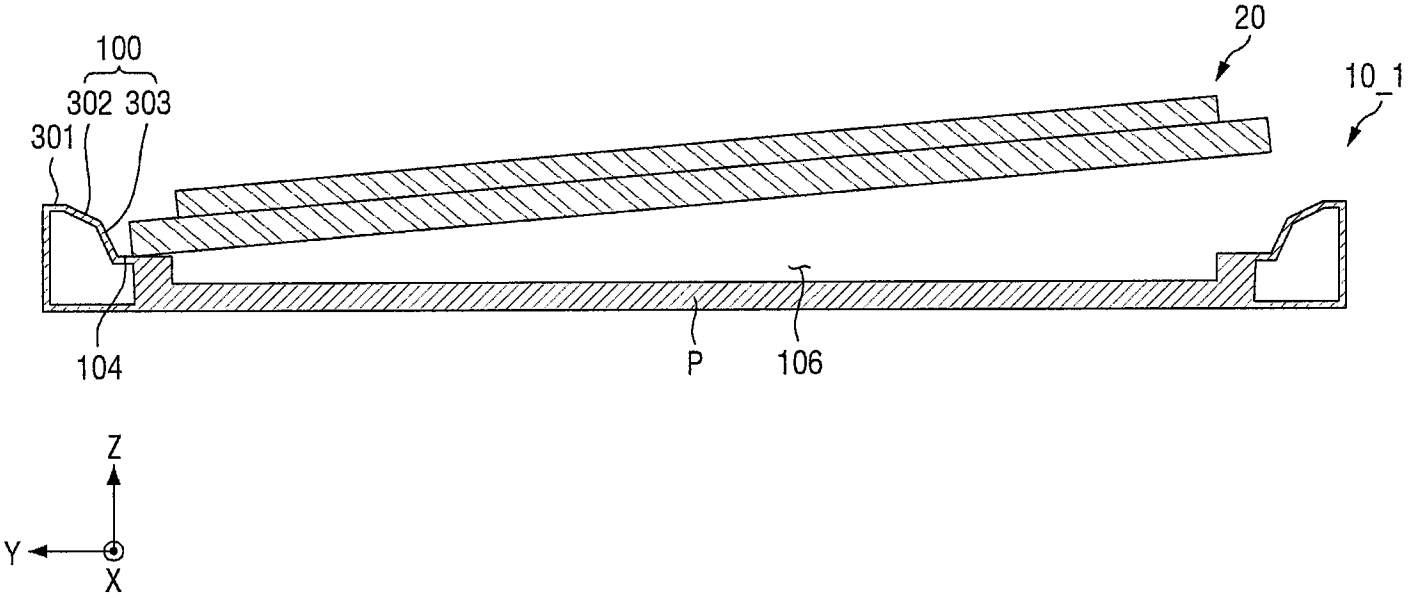

Referring to FIG. 9, as a third step, one side of the semiconductor device 20 non-elastically collides with the guide portion of the first tray 10_1. As a result, one side of the semiconductor device 20 bounds in the third direction Z and the other side of the semiconductor device 20 is tightly adhered to the inclined portion (e.g., the third inclined portion 303). In more detail, since the guide portion of the first tray 10_1 colliding with one side of the semiconductor device 20 has a constant slope, the semiconductor device 20 may be subjected to a constant force in the first direction Y, whereby the semiconductor device 20 may move in the first direction Y.

Figure 10:
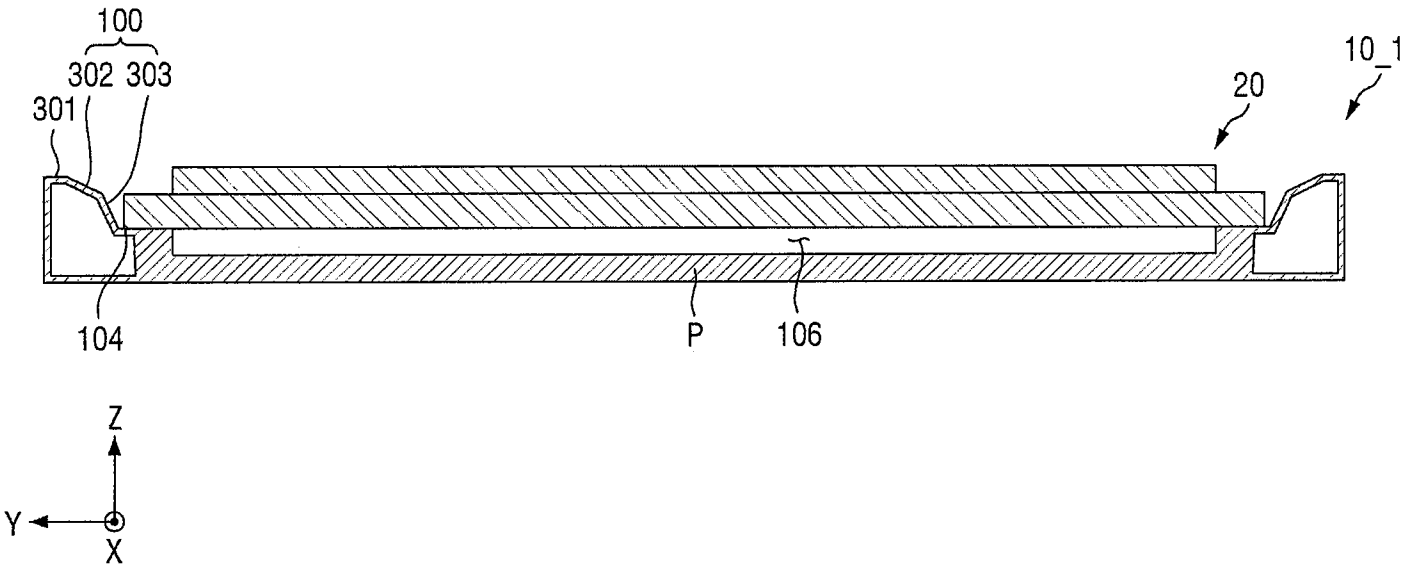

Referring to FIG. 10, as a fourth step, one side of the semiconductor device 20 is rotated clockwise so that the semiconductor device 20 may be completely loaded on the loading portion 104. Since the third inclined portion 303 forms a first angle θ1 with respect to the upper surface of the loading portion 104, the other side of the semiconductor device 20 is in contact with a line segment where the third inclined portion 303 and the loading portion 104 are connected to each other. Therefore, a portion of the other side of the semiconductor device 20, which is in contact with the line segment where the third inclined portion 303 and the loading portion 104 are connected to each other, acts as a rotary shaft so that one side of the semiconductor device 20 rotates in a clockwise direction. Since a size of a first accommodation space of the first tray 10_1 may be manufactured to be suitable for the size of the semiconductor device 20, the semiconductor device 20 may be loaded on the loading portion 104 in complete contact with the loading portion 104 of the first tray 10_1.

Figure 11:
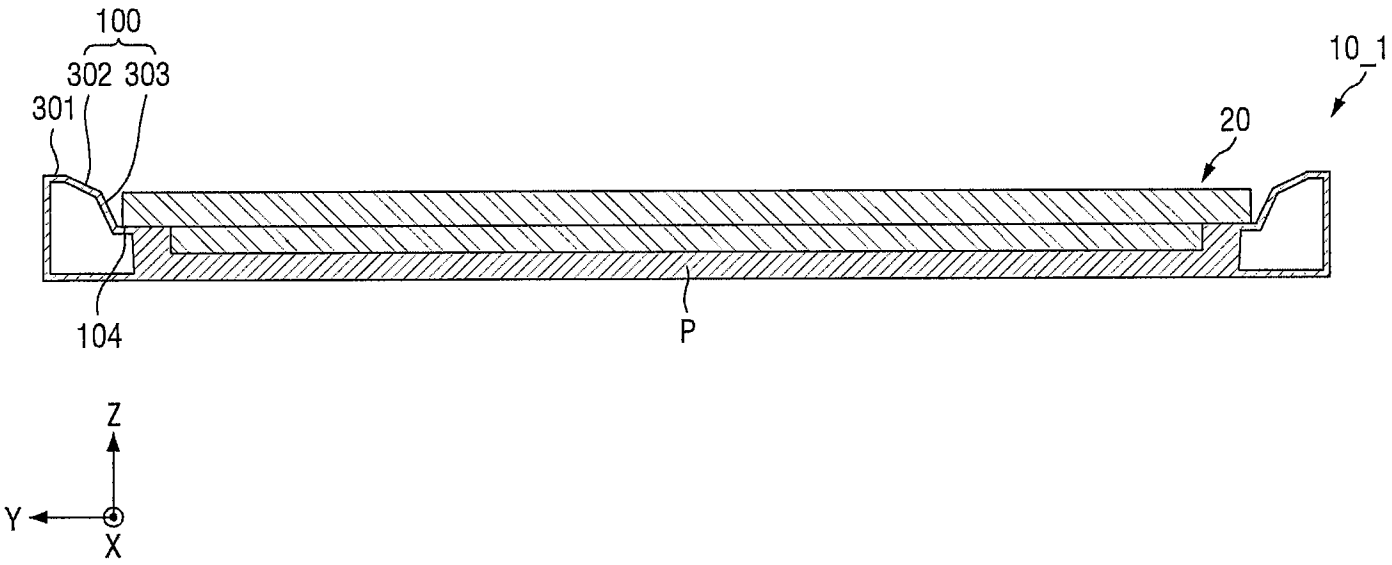
FIG. 11 is an example side view illustrating a state that a semiconductor device is loaded on a tray according to some embodiments of the present disclosure.

FIG. 11 is an example side view illustrating a state that a semiconductor device is loaded on a tray according to some embodiments of the present disclosure. FIG. 11 illustrates a state that the semiconductor device is bottom-loaded, for example.

Referring to FIGS. 10 and 11, the semiconductor device 20 may have a convex or stepped shape having a protrusion. The semiconductor device 20 may have a shape in which two plates P having different sizes are stacked. When the two plates P are referred to as a protruded plate 20_1 and a support plate 20_2, respectively, the protruded plate 201 may be protruded from the support plate 202 (see FIG. 7). Therefore, the semiconductor device 20 may have a shape in which the protruded plate 20_1 is supported by the support plate 20_2.

A side with the protruded plate 20_1 is referred to as an upper portion of the semiconductor device 20, and a side of the support plate 20_2 supporting the protruded plate 20_1 is referred to as a lower portion of the semiconductor device 20. The upper surface of the protruded plate 20_1 is referred to as the upper surface of the semiconductor device 20, and the lower surface of the support plate 20_2 is referred to as the lower surface of the semiconductor device 20.

In some embodiments, the semiconductor device 20 may include a package substrate and a semiconductor chip installed on the package substrate. The package substrate may correspond to the support plate 20_2 of FIGS. 10 and 11. The semiconductor chip may correspond to the protruded plate 20_1 of FIGS. 10 and 11.

As shown in FIG. 10, the semiconductor device 20 may be top-loaded so that the upper surface of the semiconductor device 20 is exposed. As shown in FIG. 11, the semiconductor device 20 may be bottom-loaded so that the lower surface of the semiconductor device 20 is exposed. When the semiconductor device 20 is bottom-loaded, the packaging groove 106 may have a shape suitable for the shape of the protruded plate 20_1 of the semiconductor device 20, so that the protruded plate 201 portion of the semiconductor device 20 may be received in the packaging groove 106. As a result, the semiconductor device 20 may be loaded on one first tray 10_1 as needed in a top loading or bottom loading type, thereby improving the degree of freedom in the loading method of the semiconductor device 20.

In some embodiments, a semiconductor chip may be accommodated in the packaging groove 106. When the semiconductor chip is accommodated in the packaging groove 106, the semiconductor device 20 may be bottom-loaded to block the semiconductor chip from external contaminants, thereby reducing the probability of a failure of the semiconductor device 20 in the process of transporting the semiconductor device 20.

FIGS. 10 and 11 illustrate that the semiconductor device 20 is a convex type having a protrusion, but are for convenience of description, and the shape of the semiconductor device 20 is not limited to the convex type.

Figure 12:
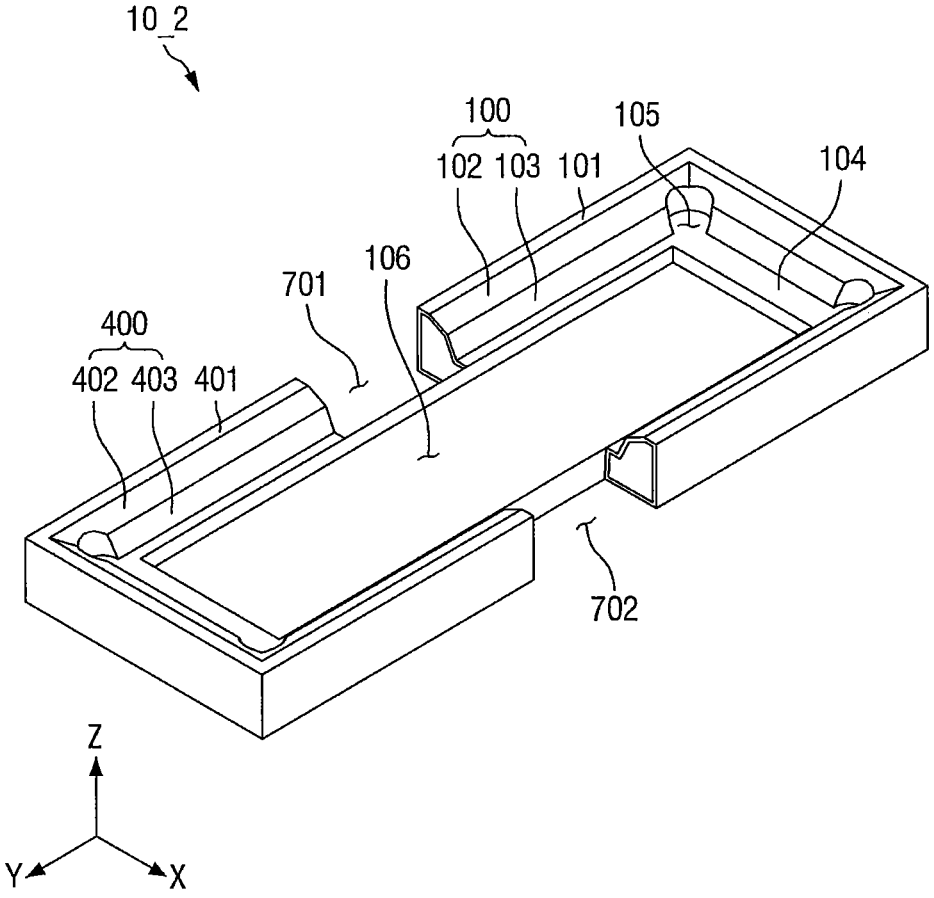
FIG. 12 is a perspective view illustrating a tray according to some embodiments of the present disclosure.
Figure 13:
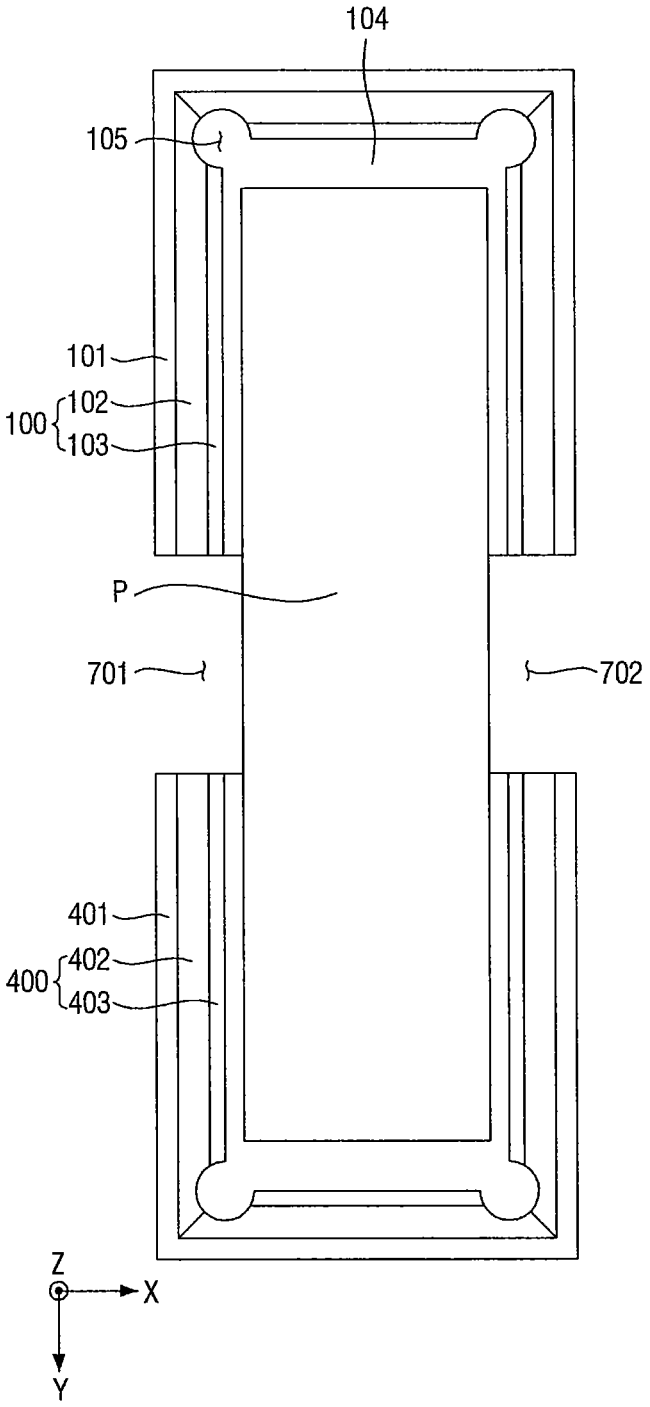
FIG. 13 is a plan view illustrating the tray shown in FIG. 12.

FIG. 12 is a perspective view illustrating a tray according to some embodiments of the present disclosure. FIG. 13 is a plan view illustrating the tray shown in FIG. 12. For convenience of description, the following description will be based on differences from the description made with reference to FIGS. 1 to 11.

Referring to FIGS. 12 and 13, the tray T may be a second tray 10_2. The second tray 10_2 may include a plate P, a loading portion 104, a sidewall portion, and an edge portion. For example, the plate P, the loading portion 104, the sidewall portion, and the edge portion may be integrally formed to form the second tray 10_2.

The sidewall portion may be formed to surround at least a portion of the loading portion 104 on the plate P, and may include a first sidewall 100 and a fourth sidewall 400.

The first sidewall 100 may be provided on a first side. The first sidewall 100 may include a first guide portion 102 and a first inclined portion 103. In this case, the first inclined portion 103 may be connected to or extend from the loading portion 104, and may form or define a first angle θ1 with respect to the upper surface of the loading portion 104. In this case, the first guide portion 102 may be connected to or extend from the first inclined portion 103, and may form or define a second angle θ2 with respect to the upper surface of the loading portion 104.

The fourth sidewall 400 may be provided on the first side. The fourth sidewall 400 may include a fourth guide portion 402 and a fourth inclined portion 403. In this case, the fourth inclined portion 403 may be connected to or extend from the loading portion 104, and may form or define a first angle θ1 with respect to the upper surface of the loading portion 104. In this case, the fourth guide portion 402 may be connected to or extend from the fourth inclined portion 403, and may form or define a second angle θ2 with respect to the upper surface of the loading portion 104.

In some embodiments, the first sidewall 100 and the fourth sidewall 400 may be provided on the first side of the plate P, and the fourth sidewall 400 may be spaced apart from the first sidewall 100.

In some embodiments, the loading portion 104 may include an empty space or recess between a portion connected to the first inclined portion 103 and a portion connected to the fourth inclined portion 403. In more detail, a first through groove 701 may be formed between the first sidewall 100 and the fourth sidewall 400. The first through groove 701 may be an empty space between the first sidewall 100 and the fourth sidewall 400. In addition, the first through groove 701 may pass through a portion of the loading portion 104. In this case, a length of the first sidewall 100 in the first direction Y may be equal to that of the fourth sidewall 400 in the first direction Y.

Figure 14:
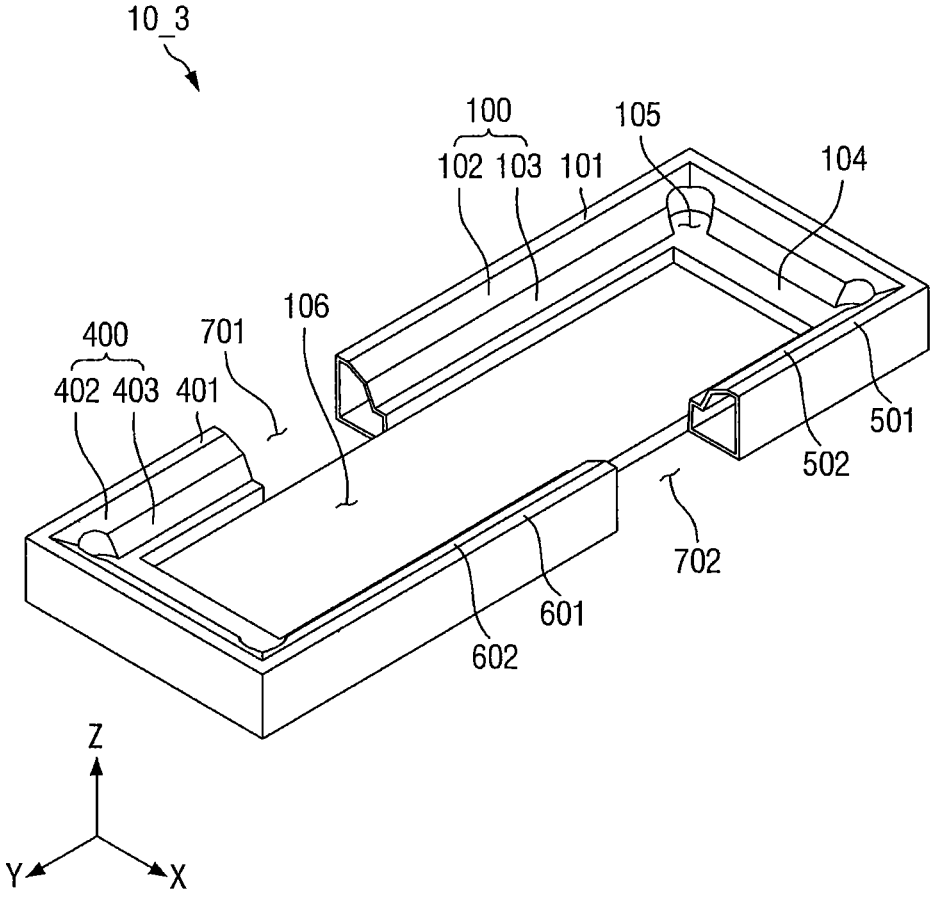
FIG. 14 is a perspective view illustrating a tray according to some embodiments of the present disclosure.
Figure 15:
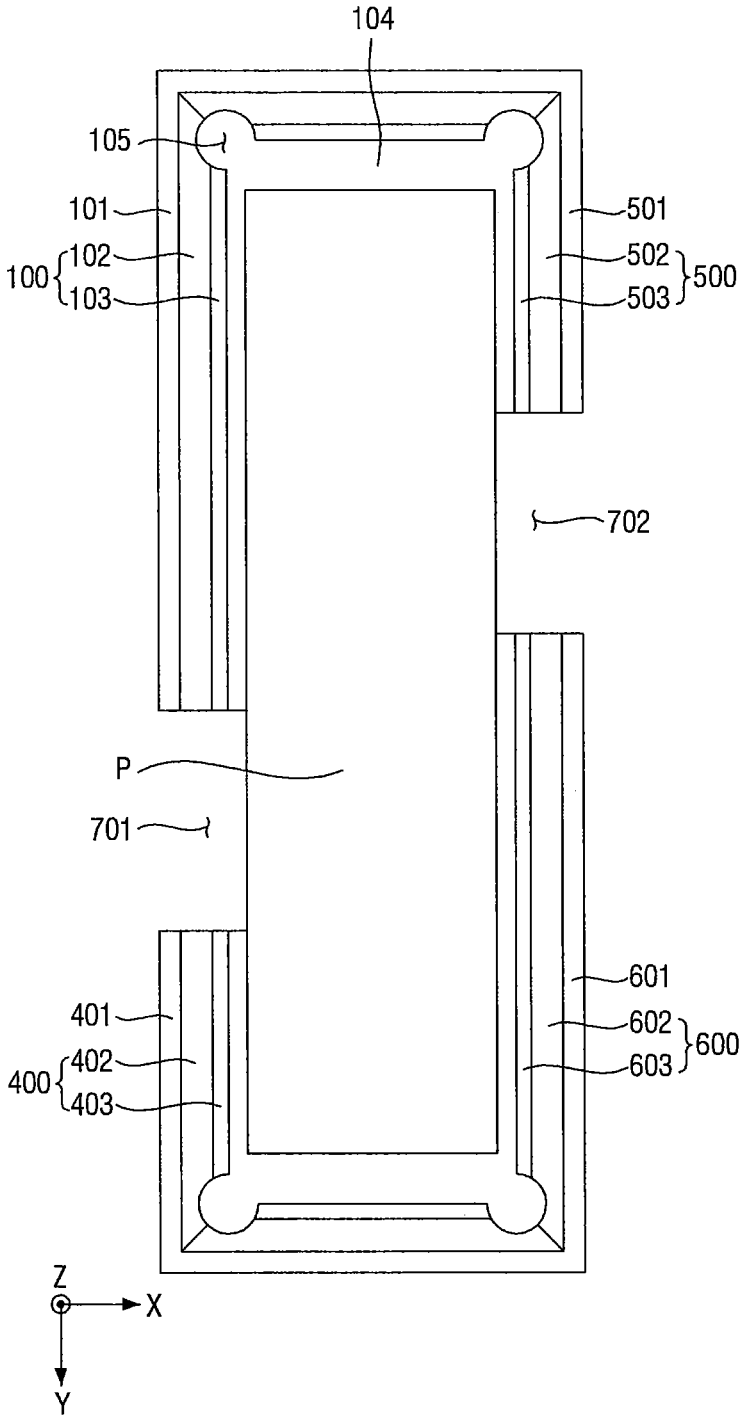
FIG. 15 is a plan view illustrating the tray shown in FIG. 14.

FIG. 14 is a perspective view illustrating a tray according to some embodiments of the present disclosure. FIG. 15 is a plan view illustrating the tray shown in FIG. 14. For convenience of description, the following description will be based on differences from the description made with reference to FIGS. 1 to 11.

Referring to FIGS. 14 and 15, the tray T may be a third tray 10_3. The third tray 10_3 may include a plate P, a loading portion 104, a sidewall portion, and an edge portion. For example, the plate P, the loading portion 104, the sidewall portion, and the edge portion may be integrally formed to form the third tray 10_3.

The sidewall portion may be formed to surround at least a portion of the loading portion 104 on the plate P, and may include a first sidewall 100, a fourth sidewall 400, a fifth sidewall 500, and a sixth sidewall 600.

The first sidewall 100 may be provided on the first side. The first sidewall 100 may include a first guide portion 102 and a first inclined portion 103. In this case, the first inclined portion 103 may be connected to or extend from the loading portion 104, and may form or define a first angle θ1 with respect to the upper surface of the loading portion 104. In this case, the first guide portion 102 may be connected to or extend from the first inclined portion 103, and may form or define a second angle θ2 with respect to the upper surface of the loading portion 104.

The fourth sidewall 400 may be provided on the first side. The fourth sidewall 400 may include a fourth guide portion 402 and a fourth inclined portion 403. In this case, the fourth inclined portion 403 may be connected to or extend from the loading portion 104, and may form or define a first angle θ1 with respect to the upper surface of the loading portion 104. In this case, the fourth guide portion 402 may be connected to or extend from the fourth inclined portion 403, and may form or define a second angle θ2 with respect to the upper surface of the loading portion 104.

In some embodiments, the first sidewall 100 and the fourth sidewall 400 may be provided on the first side of the plate P, and the fourth sidewall 400 may be spaced apart from the first sidewall 100.

In some embodiments, the loading portion 104 may include an empty space or recess between a portion connected to the first inclined portion 103 and a portion connected to the fourth inclined portion 403. In more detail, a first through groove 701 may be formed between the first sidewall 100 and the fourth sidewall 400. The first through groove 701 may be an empty space between the first sidewall 100 and the fourth sidewall 400. In addition, the first through groove 701 may pass through a portion of the loading portion 104. In this case, the length of the first sidewall 100 in the first direction Y may be different from that of the fourth sidewall 400 in the first direction Y.

The fifth sidewall 500 may be provided on the second side of the plate P, which faces or is opposite the first side. The fifth sidewall 500 may include a fifth guide portion 502 and a fifth inclined portion 503. In this case, the fifth inclined portion 503 may be connected to or extend from the loading portion 104, and may form or define a first angle θ1 with respect to the upper surface of the loading portion 104. In this case, the fifth guide portion 502 may be connected to or extend from the fifth inclined portion 503, and may form or define a second angle θ2 with respect to the upper surface of the loading portion 104.

The sixth sidewall 600 may be provided on the second side of the plate P, which faces the first side, and may be spaced apart from the fifth sidewall 500. The sixth sidewall 600 may include a sixth guide portion 602 and a sixth inclined portion 603. In this case, the sixth inclined portion 603 may be connected to or extend from the loading portion 104, and may form or define a first angle θ1 with respect to the upper surface of the loading portion 104. In this case, the sixth guide portion 602 may be connected to or extend from the sixth inclined portion 603, and may form or define a second angle θ2 with respect to the upper surface of the loading portion 104.

In some embodiments, the fifth sidewall 500 and the sixth sidewall 600 may be on the second side of the plate P, which faces or is opposite the first side, and the fifth sidewall 500 may be spaced apart from the sixth sidewall 600.

In some embodiments, the loading portion 104 may include an empty space or recess between a portion connected to the fifth inclined portion 503 and a portion connected to the sixth inclined portion 603. In more detail, a second through groove 702 may be formed between the fifth sidewall 500 and the sixth sidewall 600. The second through groove 702 may be an empty space between the fifth sidewall 500 and the sixth sidewall 600. In addition, the second through groove 702 may pass through a portion of the loading portion 104. In this case, the length of the fifth sidewall 500 in the first direction Y may be different from that of the sixth sidewall 600 in the first direction Y.

When the first sidewall 100 and the fourth sidewall 400 are provided to be spaced apart from each other, the loading portion 104 includes an empty space between a portion connected to the first inclined portion 103 and a portion connected to the fourth inclined portion 403, the fifth sidewall 500 and the sixth sidewall 600 are provided to be spaced apart from each other, and the loading portion 104 includes an empty space between a portion connected to the fifth inclined portion 503 and a portion connected to the sixth inclined portion 603, the semiconductor device transfer picker may more easily grip the semiconductor device 20. For example, the semiconductor device transfer picker may have a tongs shape, and a tongs portion may be inserted into the first through groove 701 and the second through groove 702 of the second tray 10_2 so that the semiconductor device transfer picker may grip the semiconductor device 20. As a result, the semiconductor device transfer picker may precisely adjust the position of the semiconductor device 20 through a structure in which the sidewalls adjacent to each other in the first direction Y are provided to be spaced apart from each other.

The first through groove 701 and the second through groove 702 may be aligned with each other in the first direction Y as shown in FIGS. 12 and 13. Alternatively, the first through groove 701 and the second through groove 702 may be offset from each other in the first direction Y as shown in FIGS. 14 and 15.

Figure 16:
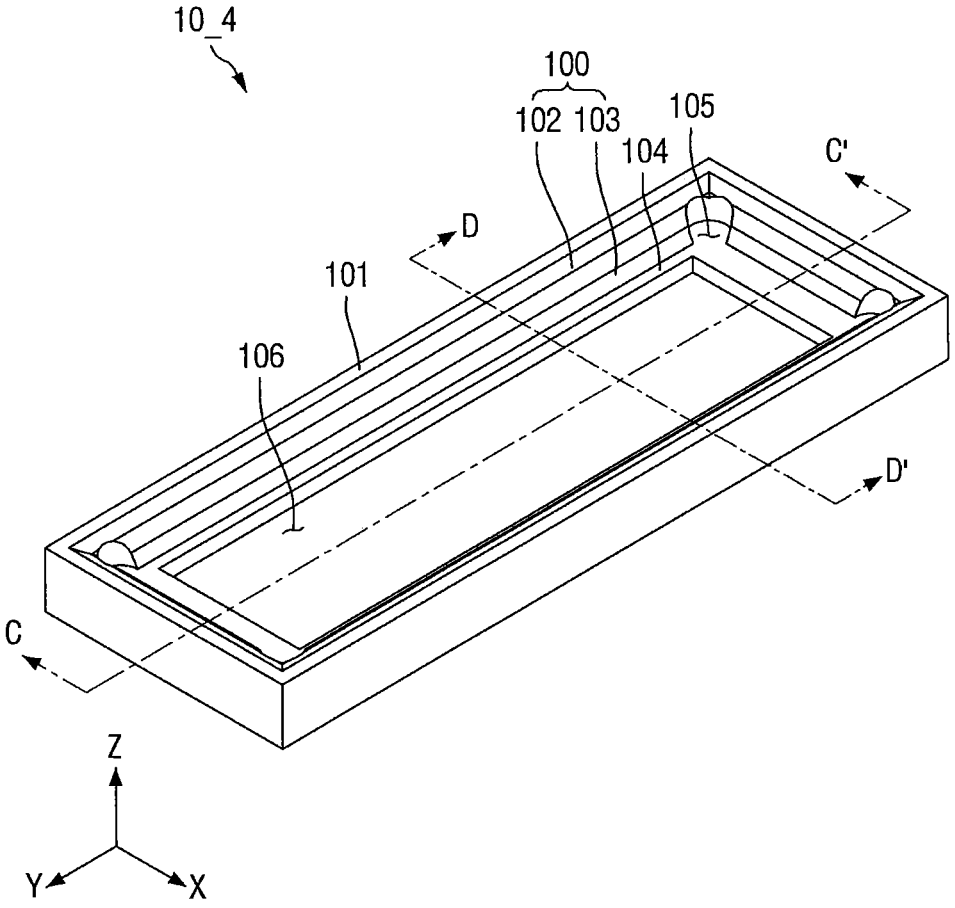
FIG. 16 is a perspective view illustrating a tray according to some embodiments of the present disclosure.
Figure 17:
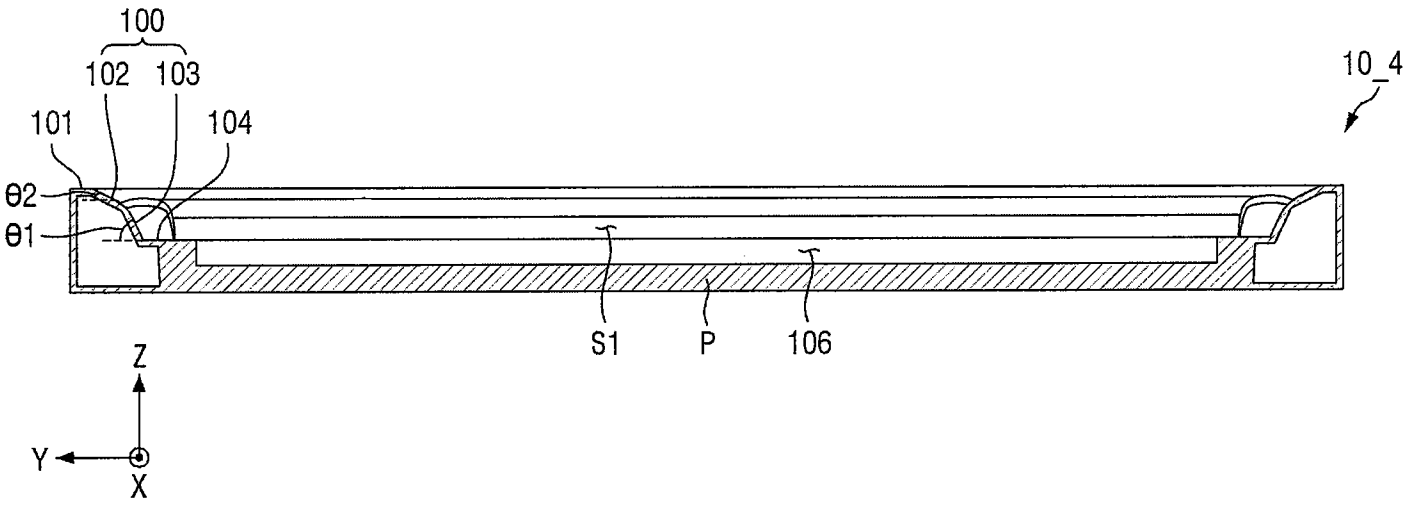
FIG. 17 is a cross-sectional view taken along line C-C' of FIG. 16.
Figure 18:
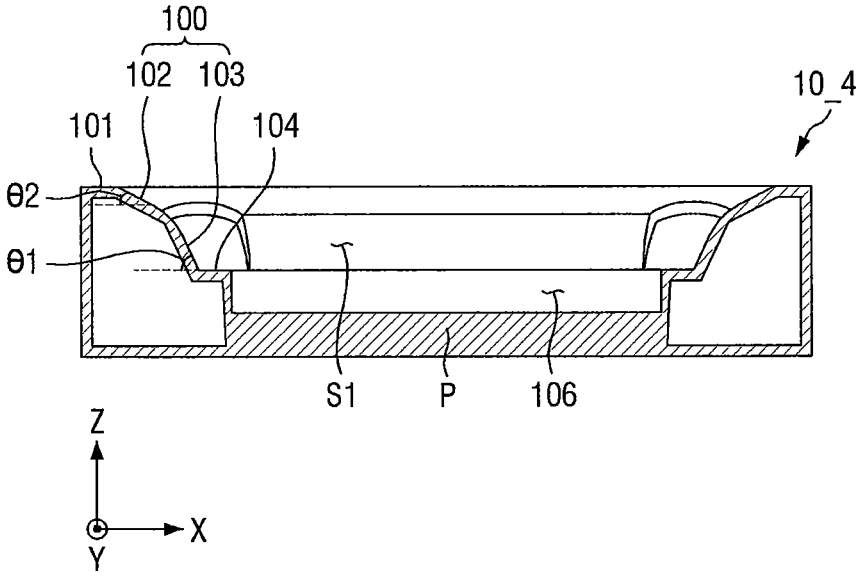
FIG. 18 is a cross-sectional view taken along line D-D' of FIG. 16.

FIG. 16 is a perspective view illustrating a tray according to some embodiments of the present disclosure. FIG. 17 is a cross-sectional view taken along line C-C' of FIG. 16. FIG. 18 is a cross-sectional view taken along line D-D' of FIG. 16. For convenience of description, the following description will be based on differences from the description made with reference to FIGS. 1 to 11.

Referring to FIGS. 16 to 18, the tray T may be a fourth tray 10_4. The fourth tray 10_4 may include a plate P, a loading portion 104, a sidewall portion, and an edge portion. For example, the plate P, the loading portion 104, the sidewall portion, and the edge portion may be integrally formed to form the fourth tray 10_4.

The sidewall portion may be formed to surround at least a portion of the loading portion 104 on the plate P, and may include a first sidewall 100. The first sidewall 100 may include a first inclined portion 103 and a first guide portion 102. The first inclined portion 103 may be connected to or extend from the loading portion 104, and may form a first angle θ1 with respect to the upper surface of the loading portion 104. The first guide portion 102 may be connected to or extend from the first inclined portion 103, and may form a second angle θ2 with respect to the upper surface of the loading portion 104.

A portion connecting the first inclined portion 103 with the first guide portion 102 may be a curved surface. When the portion connecting the first inclined portion 103 with the first guide portion 102 has an angled shape, there is a possibility that the semiconductor device 20 may be caught between the first guide portion 102 and the first inclined portion 103 while sliding along the first guide portion 102. When the portion connecting the first inclined portion 103 with the first guide portion 102 is a curved surface, the semiconductor device 20 may pass between the first guide portion 102 and the first inclined portion 103 more smoothly while sliding along the first guide portion 102. Therefore, when the portion connecting the first inclined portion 103 with the first guide portion 102 is a curved surface, the probability that the semiconductor device 20 is damaged by impact may be reduced.

Figure 19:
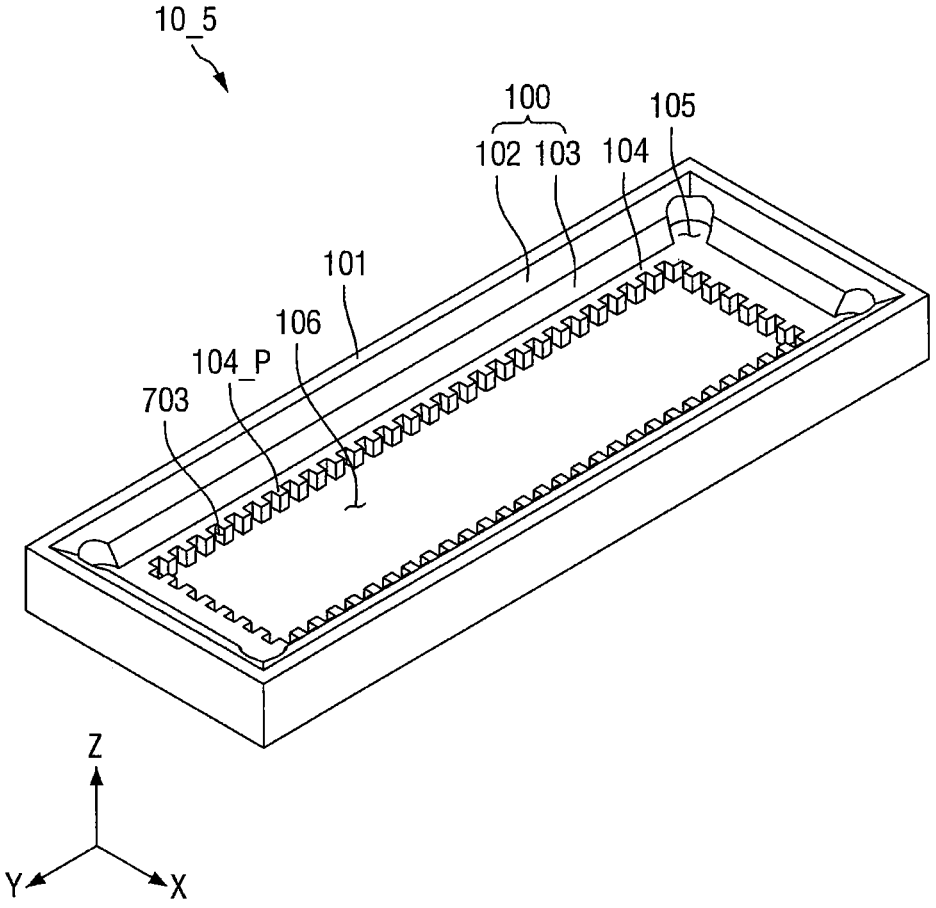
FIG. 19 is a perspective view illustrating a tray according to some embodiments of the present disclosure.
Figure 20:
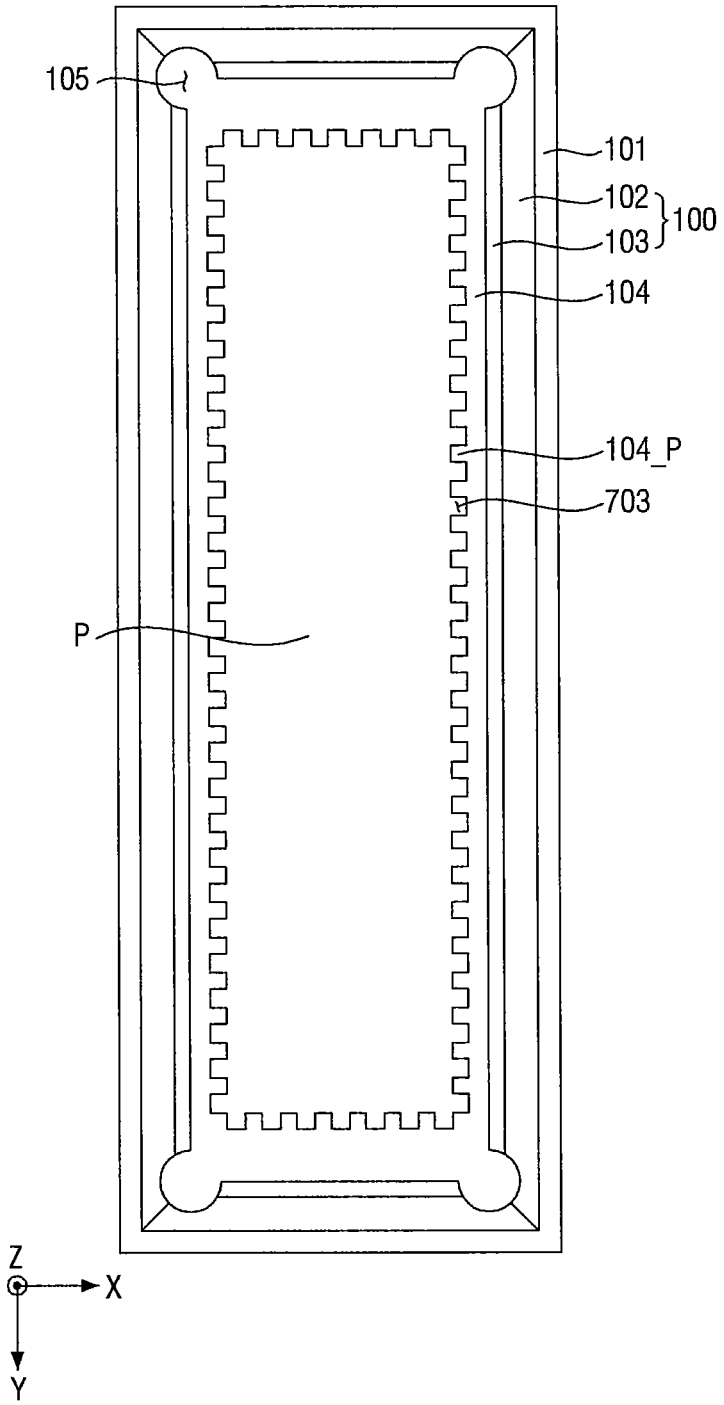
FIG. 20 is a plan view illustrating the tray shown in FIG. 19.

FIG. 19 is a perspective view illustrating a tray according to some embodiments of the present disclosure. FIG. 20 is a plan view illustrating the tray shown in FIG. 19. For convenience of description, the following description will be based on differences from the description made with reference to FIGS. 1 to 11.

Referring to FIGS. 19 and 20, the tray T may be a fifth tray 10_5. The fifth tray 10_5 may include a plate P, a loading portion 104, a sidewall portion, and an edge portion. For example, the plate P, the loading portion 104, the sidewall portion, and the edge portion may be integrally formed to form the fifth tray 10_5.

The loading portion 104 may be a structure extending along the periphery of the plate P, having a thickness in the third direction Z. For example, the loading portion 104 may extend along an outer edge of the plate P. In addition, the loading portion 104 may be a structure covering only a portion of the upper surface of the plate P. Therefore, when the tray T is viewed in the third direction Z, a portion of the upper surface of the plate P may be observed.

The loading portion 104 may include a protruded loading portion 104_P (also referred to herein as a tooth or teeth). The protruded loading portion 104_P is a structure protruding or extending toward the inside of the tray T or away from the sidewall portion. Adjacent protruded loading portions or teeth 104_P may be disposed to be spaced apart from each other, and a third through groove 703 may be formed between the adjacent protruded loading portions 104_P. The third through groove 703 may be an empty space between the adjacent protruded loading portions 104_P. In addition, the third through groove 703 may pass through a portion of the loading portion 104. Therefore, the plurality of protruded loading portions 104_P and the third through groove 703 may be alternately disposed along an inner edge, sidewall, or surface of the loading portion 104.

In some embodiments, the protruded loading portion 104_P may be a structure protruding or extending from the loading portion 104. The protruded loading portion 104_P may protrude in a rectangular or rectangular parallelepiped shape.

Figure 21:
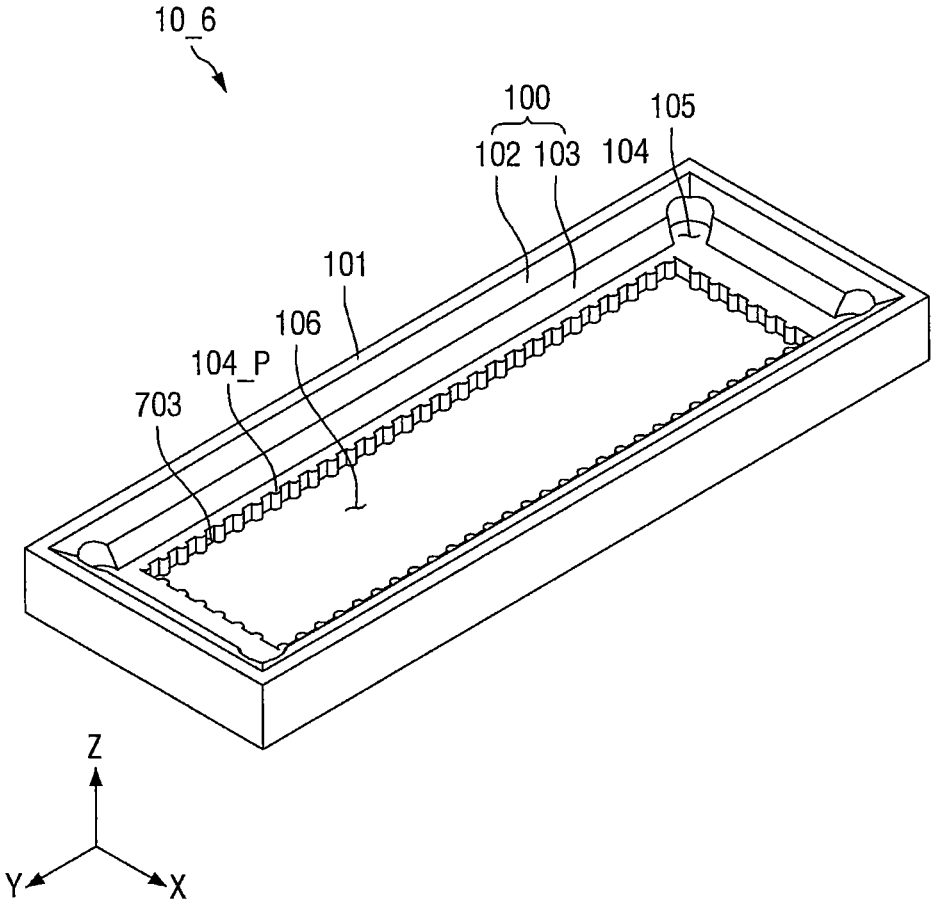
FIG. 21 is a perspective view illustrating a tray according to some embodiments of the present disclosure.
Figure 22:
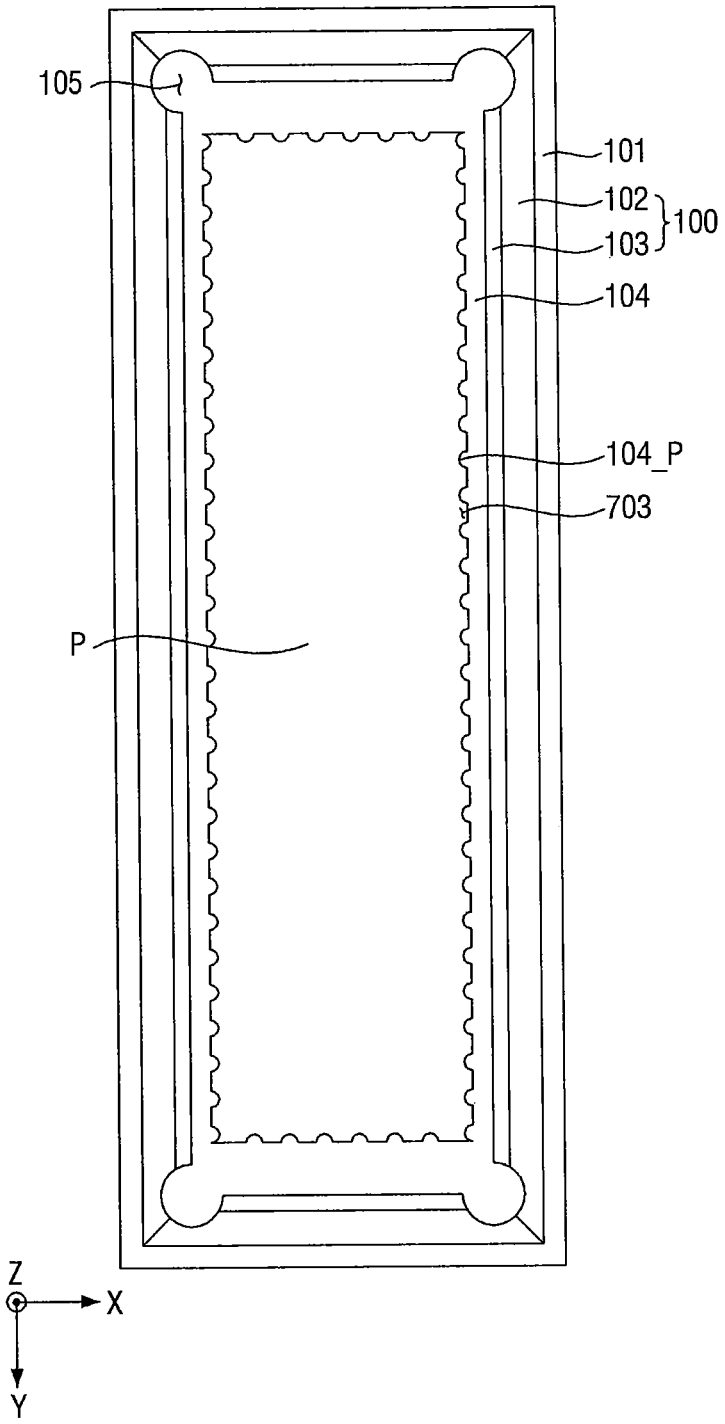
FIG. 22 is a plan view illustrating the tray shown in FIG. 21.

FIG. 21 is a perspective view illustrating a tray according to some embodiments of the present disclosure. FIG. 22 is a plan view illustrating the tray shown in FIG. 21. For convenience of description, the following description will be based on differences from the description made with reference to FIGS. 19 to 20.

Referring to FIGS. 21 and 22, the tray T may be a sixth tray 10_6. The sixth tray 10_6 may include a plate P, a loading portion 104, a sidewall portion, and an edge portion. The loading portion 104 may be a structure extending along the periphery of the plate P, having a thickness in the third direction Z. The loading portion 104 may include a protruded loading portion 104_P (also referred to herein as a tooth or teeth).

In some embodiments, the protruded loading portion 104_P may be a structure protruding or extending from the loading portion 104. The protruded loading portion 104_P may protrude in a rounded or semi-cylindrical shape.

Figure 23:
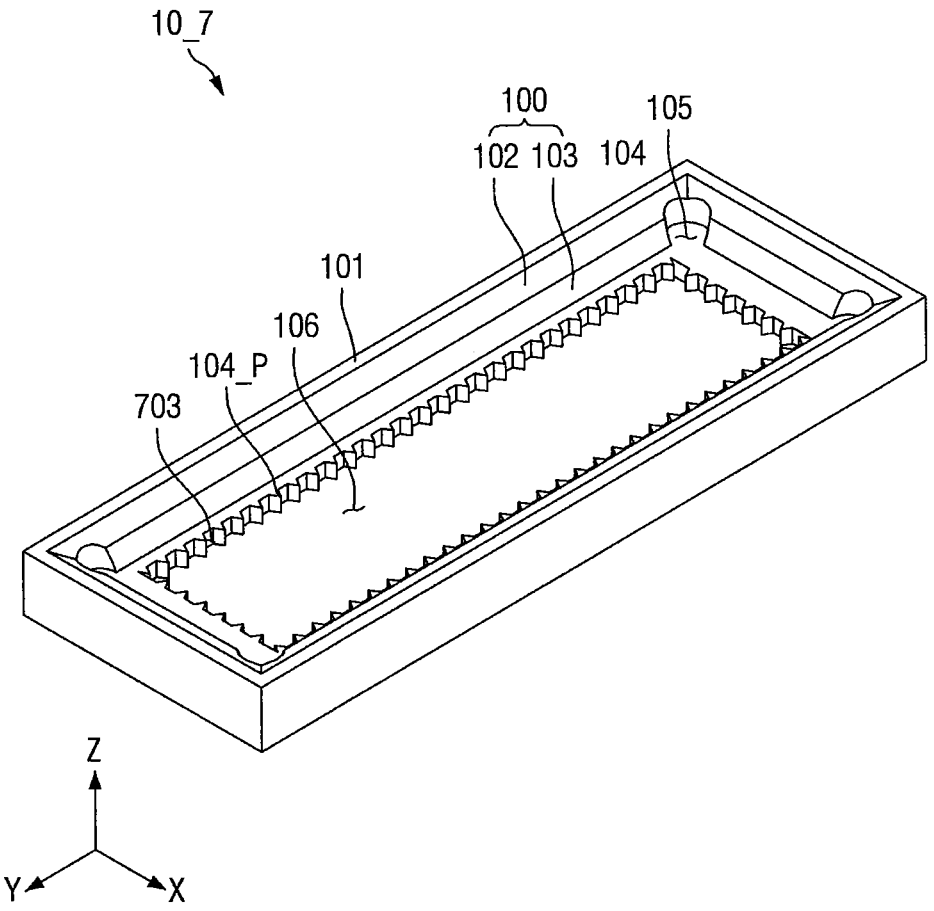
FIG. 23 is a perspective view illustrating a tray according to some embodiments of the present disclosure.
Figure 24:
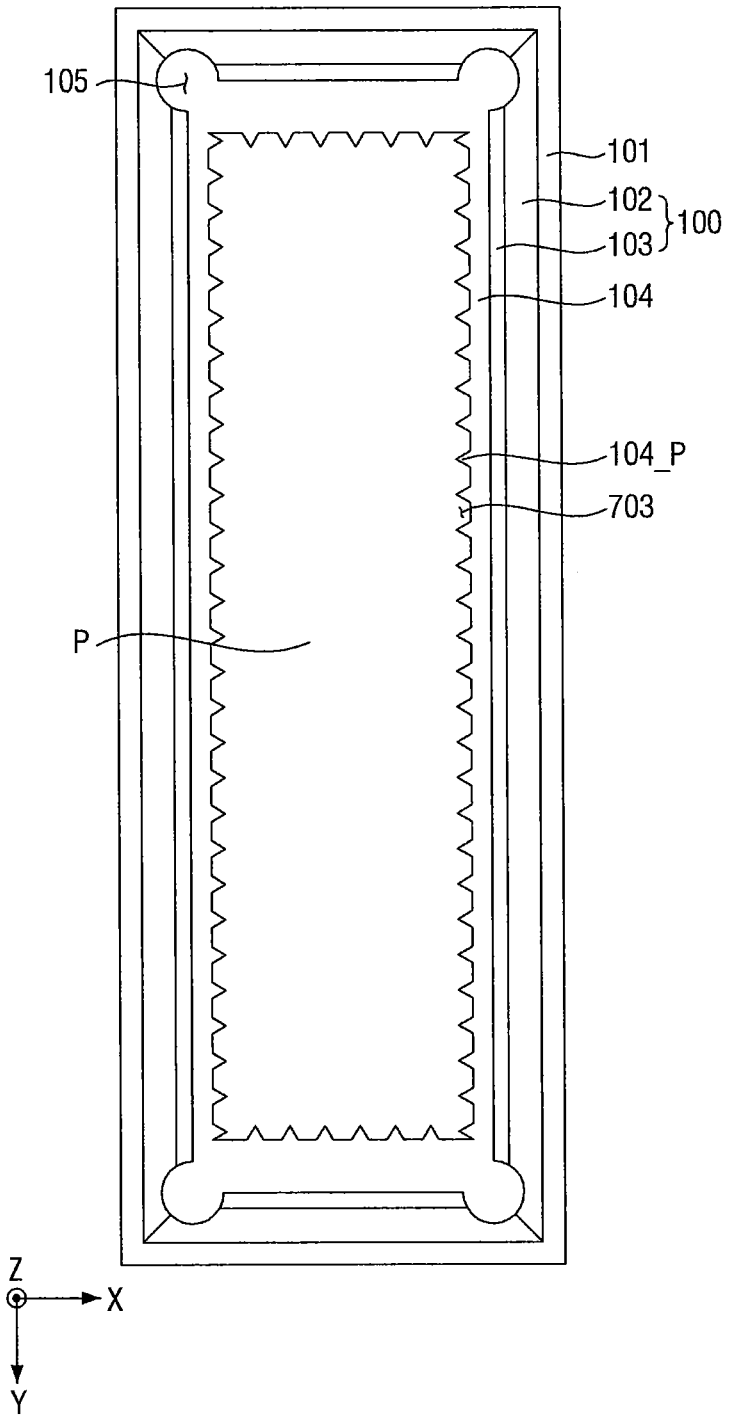
FIG. 24 is a plan view illustrating the tray shown in FIG. 23.

FIG. 23 is a perspective view illustrating a tray according to some embodiments of the present disclosure. FIG. 24 is a plan view illustrating the tray shown in FIG. 23. For convenience of description, the following description will be based on differences from the description made with reference to FIGS. 19 and 20.

Referring to FIGS. 23 and 24, the tray T may be a seventh tray 10_7. The seventh tray 10_7 may include a plate P, a loading portion 104, a sidewall portion, and an edge portion. The loading portion 104 may be a structure extending along the periphery of the plate P, having a thickness in the third direction Z. The loading portion 104 may include a protruded loading portion 104_P (also referred to herein as a tooth or teeth).

In some embodiments, the protruded loading portion 104_P may be a structure protruding or extending from the loading portion 104. The protruded loading portion 104_P may protrude in a triangular shape or in the form of a triangular prism.

Figure 25:
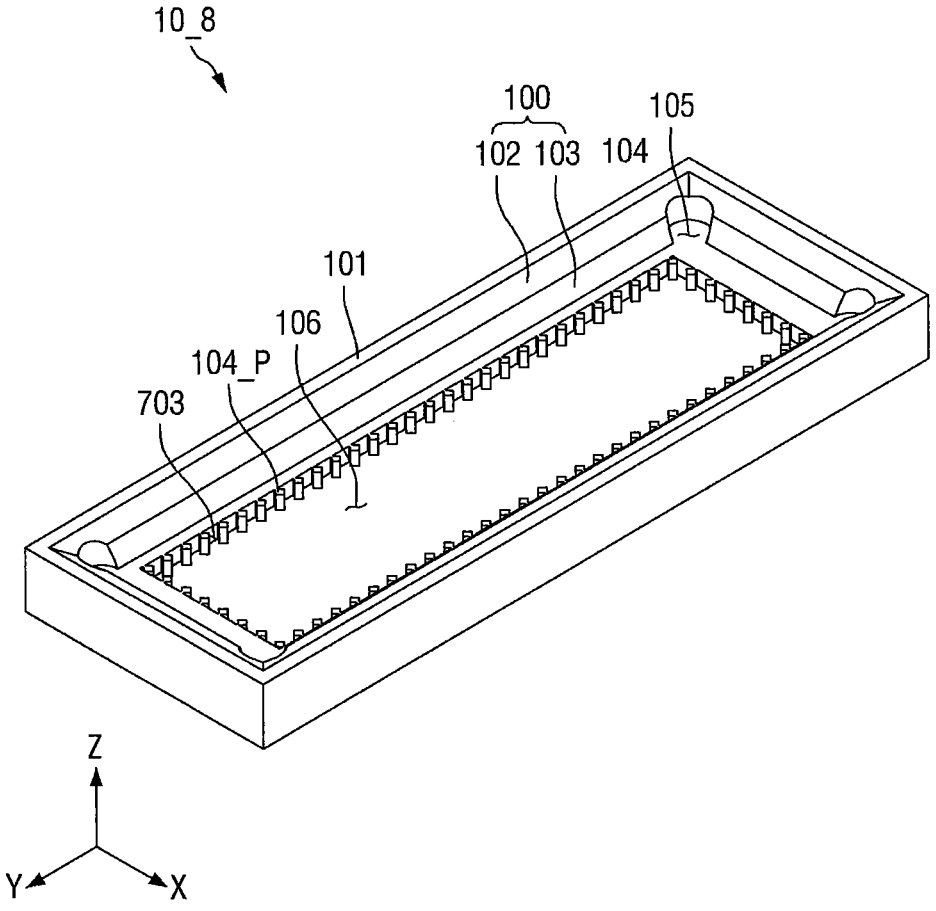
FIG. 25 is a perspective view illustrating a tray according to some embodiments of the present disclosure.
Figure 26:
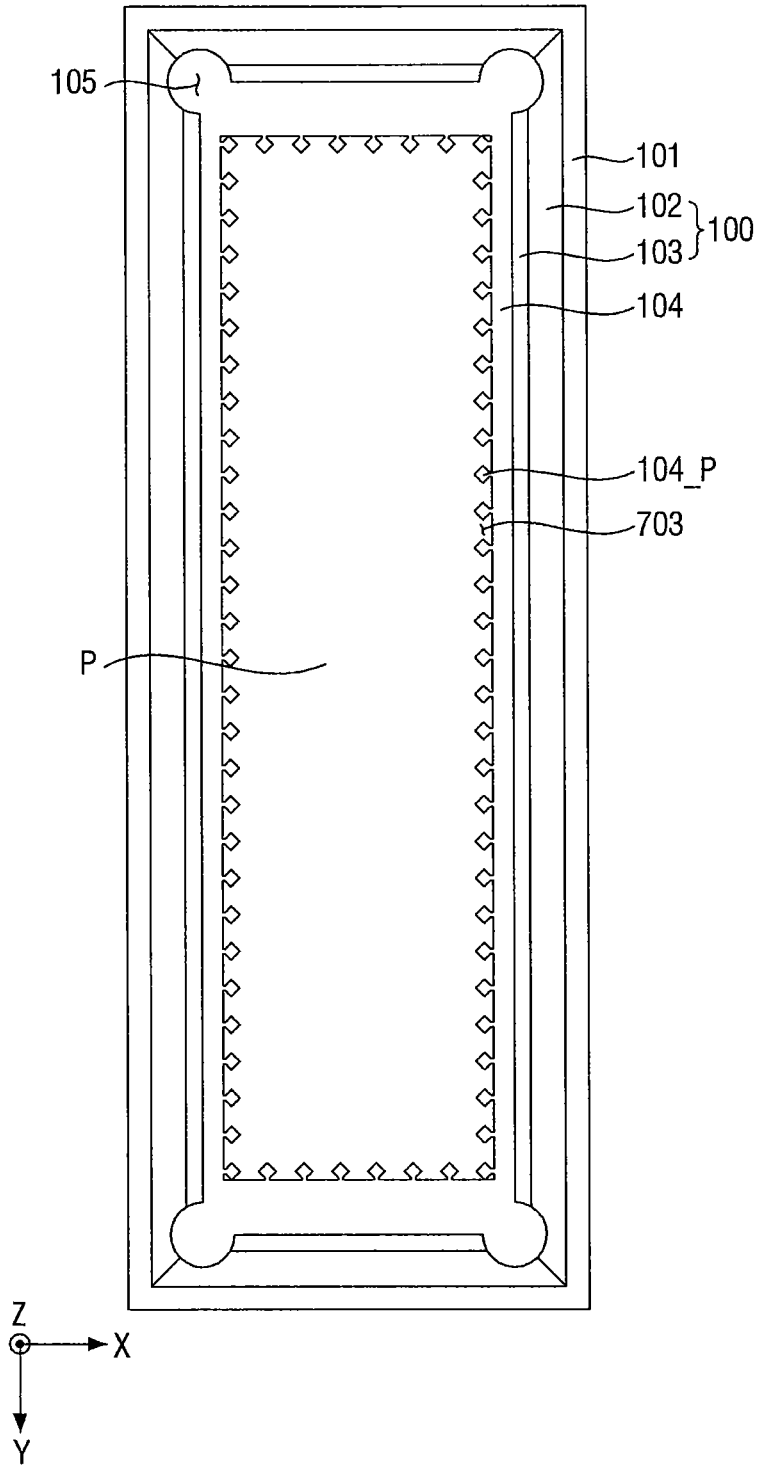
FIG. 26 is a plan view illustrating the tray shown in FIG. 25.

FIG. 25 is a perspective view illustrating a tray according to some embodiments of the present disclosure. FIG. 26 is a plan view illustrating the tray shown in FIG. 25. For convenience of description, the following description will be based on differences from the description made with reference to FIGS. 19 and 20.

Referring to FIGS. 25 and 26, the tray T may be an eighth tray 10_8. The eighth tray 10_8 may include a plate P, a loading portion 104, a sidewall portion, and an edge portion. The loading portion 104 may be a structure extending along the periphery of the plate P, having a thickness in the third direction Z. The loading portion 104 may include a protruded loading portion 104_P (also referred to herein as a tooth or teeth).

In some embodiments, the protruded loading portion 104_P may be a structure protruding or extending from the loading portion 104. The protruded loading portion 104_P may protrude in the form of a square pillar in which an upper surface and a bottom surface are rhombus, and one corner of a sidewall of a square pillar of which upper surface and bottom surface are rhombus may be connected to the loading portion. The protruded loading portion 104_P may protrude in a diamond shape.

In some embodiments, the protruded loading portion 104_P is shown as being protruding in a rectangular parallelepiped shape, a semicircular pillar, a triangular pillar shape, and a rectangular pillar shape of which upper surface and bottom surface are rhombus, but is not limited thereto.

In concluding the detailed description, those skilled in the art will appreciate that many variations and modifications may be made to the example embodiments without substantially departing from the principles of the present inventive concepts. Therefore, the disclosed example embodiments of the inventive concepts are used in a generic and descriptive sense only and not for purposes of limitation.

What is claimed is:

1. A tray for transporting a semiconductor device, the tray comprising:

a plate;

a loading portion on the plate and configured to support the semiconductor device; and a sidewall portion on the plate and surrounding at least a portion of the loading portion, wherein the sidewall portion includes a first sidewall, and wherein the first sidewall includes:

a first inclined portion extending from the loading portion and defining a first angle with respect to an upper surface of the loading portion and configured to support an outer sidewall of the semiconductor device; and a first guide portion extending from the first inclined portion and defining a second angle with respect to the upper surface of the loading portion, the second angle being smaller than the first angle, wherein the first angle and the second angle are acute angles, and wherein: the first sidewall is on a first side of the plate, the sidewall portion further includes a fourth sidewall on the first side of the plate and spaced apart from the first sidewall, the fourth sidewall includes a fourth inclined portion extending from the loading portion and defining the first angle with respect to the upper surface of the loading portion, and a fourth guide portion extending from the fourth inclined portion and defining the second angle with respect to the upper surface of the loading portion, and the loading portion includes an empty space or recess between a portion connected to the first inclined portion and a portion connected to the fourth inclined portion.

2. The tray of claim 1, wherein the plate extends in a first direction (Y), and a length of the first sidewall in the first direction (Y) and a length of the fourth sidewall in the first direction (Y) are different from each other.

3. The tray of claim 1, wherein: the sidewall portion further includes a fifth sidewall on a second side of the plate facing the first side, the fifth sidewall includes a fifth inclined portion extending from the loading portion and defining the first angle with respect to the upper surface of the loading portion, and a fifth guide portion extending from the fifth inclined portion and defining the second angle with respect to the upper surface of the loading portion.

4. The tray of claim 3, wherein the plate extends in a first direction (Y), and a length of the first sidewall in the first direction (Y) and a length of the fifth sidewall in the first direction (Y) are different from each other.

5. The tray of claim 3, wherein: the sidewall portion further includes a sixth sidewall on the second side of the plate and spaced apart from the fifth sidewall, the sixth sidewall includes a sixth inclined portion extending from the loading portion and defining the first angle with respect to the upper surface of the loading portion, and a fifth sixth guide portion extending from the sixth inclined portion and defining the second angle with respect to the upper surface of the loading portion, the loading portion includes an empty space or recess between a portion connected to the fifth inclined portion and a portion connected to the sixth inclined portion, and a length of the first sidewall in a first direction (Y) and a length of the sixth sidewall in the first direction (Y) are equal.

6. The tray of claim 1, wherein a portion connecting the first inclined portion with the first guide portion includes a curved surface.

7. The tray of claim 1, wherein the loading portion comprises a plurality of spaced apart teeth at an inner surface of the loading portion and extending away from the sidewall portion.

* * * * *